US007858284B2

(12) United States Patent
Oki et al.

(10) Patent No.: US 7,858,284 B2
(45) Date of Patent: Dec. 28, 2010

(54) LIQUID DEVELOPER AND IMAGE FORMING APPARATUS

(75) Inventors: Masahiro Oki, Shiojiri (JP); Takashi Teshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 126 days.

(21) Appl. No.: 12/351,344

(22) Filed: Jan. 9, 2009

(65) Prior Publication Data

US 2009/0181318 A1 Jul. 16, 2009

(30) Foreign Application Priority Data

Jan. 11, 2008 (JP) ..... 2008-004741
Aug. 25, 2008 (JP) ..... 2008-215833

(51) Int. Cl.
*G03G 9/13* (2006.01)
*G03G 9/12* (2006.01)
*G03G 15/01* (2006.01)

(52) U.S. Cl. ..... 430/114; 430/112; 430/115; 399/122; 399/233

(58) Field of Classification Search ..... 430/114, 430/112, 115; 399/122, 233
See application file for complete search history.

(56) References Cited

U.S. PATENT DOCUMENTS

| | | | | |
|---|---|---|---|---|
| 3,669,886 | A | 6/1972 | Kosel | |
| 4,097,391 | A | 6/1978 | Moschovis et al. | |
| 6,447,973 | B1 * | 9/2002 | Asami et al. | 430/114 |
| 2008/0118856 | A1 * | 5/2008 | Ivanova | 430/113 |

FOREIGN PATENT DOCUMENTS

| | | |
|---|---|---|
| GB | 1427273 A | 3/1976 |
| JP | 3332961 | 10/2002 |

* cited by examiner

*Primary Examiner*—Hoa V Le
(74) *Attorney, Agent, or Firm*—DLA Piper LLP (US)

(57) ABSTRACT

A liquid developer includes an insulation liquid, toner particles dispersed in the insulation liquid, which at least a part of the surface of each of the toner particles contains a rosin resin and a dispersant improving dispersibility of the toner particles in the insulation liquid, which the dispersant is consisted of a material having a predetermined amine value. The liquid developer described above has superior positive charge property of toner particles and which has superior dispersibility of the toner particles for a long period of time. Further, an image forming apparatus that can suitably use such a liquid developer is also provided.

9 Claims, 4 Drawing Sheets

LIQUID DEVELOPER AND IMAGE FORMING APPARATUS

CROSS-REFERENCE TO RELATED APPLICATION

This application claims priorities to Japanese Patent Applications No. 2008-004741 filed on Jan. 11, 2008 and No. 2008-215833 filed on Aug. 25, 2008 which are hereby expressly incorporated by reference herein in their entireties.

BACKGROUND

1. Technical Field

The present invention relates to a liquid developer and an image forming apparatus, and in particular relates to a liquid developer and an image forming apparatus that can use the liquid developer.

2. Related Art

As a developer used for developing an electrostatic latent image formed on a latent image carrier, a liquid developer (liquid toner) is known. Such a liquid developer is obtained by dispersing toner particles in a carrier liquid (an insulation liquid) having electric insulation properties. The toner particles are formed of a material containing a coloring agent such as a pigment or the like and a binder resin.

Conventionally, a synthetic resin such as a polyester resin, a styrene-acrylate ester copolymer and an epoxy resin or the like is used as a material for constituting the toner particles used in the liquid developer. The toner particles containing such a resin are easy to handle. Further, in the developing method using the liquid developer containing the toner particles, it is possible to produce an image having good color development with high fixing characteristic.

However, in the conventional liquid developer, the resin constituting the toner particles described above has low affinity with the insulation liquid. Therefore, it is difficult to make the toner particles disperse in the insulation liquid sufficiently.

In order to improve the dispersibility of the toner particles in the insulation liquid, it is attempted that a rosin resin having high affinity with the insulation liquid is used as a resin constituting the toner particles. One example of such a liquid developer is disclosed in JP Patent No. 3332961.

However, in the liquid developer disclosed in the above document, although the toner particles containing the rosin resin have good dispersibility in the insulation liquid at the early stage of the preservation of the liquid developer, aggregation of the toner particles is likely to occur during the preservation with the elapse of time. Therefore, there is a problem in that it is difficult to keep the good dispersibility of the toner particles in the insulation liquid for a long period of time. Further, there is another problem in that such toner particles used in the conventional liquid developer do not have sufficient charge property (in particular, positive charge property).

SUMMARY

Accordingly, it is an object of the present invention to provide a liquid developer which has superior positive charge property and superior dispersibility of the toner particles for a long period of time. Further, it is also an object of the present invention to provide an image forming apparatus that can suitably use such a liquid developer.

These objects are achieved by the present invention described below.

In a first aspect of the present invention, there is provided a liquid developer which comprises an insulation liquid, toner particles dispersed in the insulation liquid, and a dispersant that improves dispersibility of the toner particles in the insulation liquid, wherein at least a part of a surface of each of the toner particles contains a rosin resin and the dispersant is consisted of a material having a predetermined amine value.

In the liquid developer according to the present invention, it is preferred that the predetermined amine value of the material is in a range of 1 to 100 mgKoH/g.

In the liquid developer according to the present invention, it is preferred that the material constituting the dispersant has at least one of secondary amine groups, tertiary amine groups and amide bonds in its chemical structure.

In the liquid developer according to the present invention, it is preferred that in the liquid developer, an amount of the dispersant is in a range of 0.2 to 10 parts by weight with respect to 100 parts by weight of the toner particles.

In the liquid developer according to the present invention, it is preferred that the toner particles contain a resin having ester bonds in its chemical structure in addition to the rosin resin.

In the liquid developer according to the present invention, it is preferred that a softening point of the rosin resin is in a range of 80 to 190° C.

In the liquid developer according to the present invention, it is preferred that a weight-average molecular weight of the rosin resin is in a range of 500 to 100000.

In the liquid developer according to the present invention, it is preferred that the insulation liquid contains vegetable oil as a major component thereof.

In a second aspect of the present invention, there is provided an image forming apparatus. The image forming apparatus is provided with a plurality of developing sections that form a plurality of monochromatic color images using a plurality of liquid developers of different colors, an intermediate transfer section to which the plurality of monochromatic color images formed by the developing sections are sequentially transferred to form an intermediate transfer image which is formed by overlaying the transferred monochromatic color images one after another, a secondary transfer section that transfer the intermediate transfer image onto a recording medium to form an unfixed image onto the recording medium, and a fixing device that fixes the unfixed image onto the recording medium, wherein each of the plurality of liquid developers of different colors comprises an insulation liquid, toner particles dispersed in the insulation liquid, and a dispersant for improving dispersibility of the toner particles in the insulation liquid, and wherein at least a part of the surface of each of the toner particles contains a rosin resin and the dispersant is consisted of a material having a predetermined amine value.

According to the invention as described above, it is possible to provide a liquid developer which has superior positive charge property and superior dispersibility of the toner particles for a long period of time. Further, it is also possible to provide an image forming apparatus that can use such a liquid developer suitably.

DESCRIPTION OF EXEMPLARY EMBODIMENTS

Figure 1:
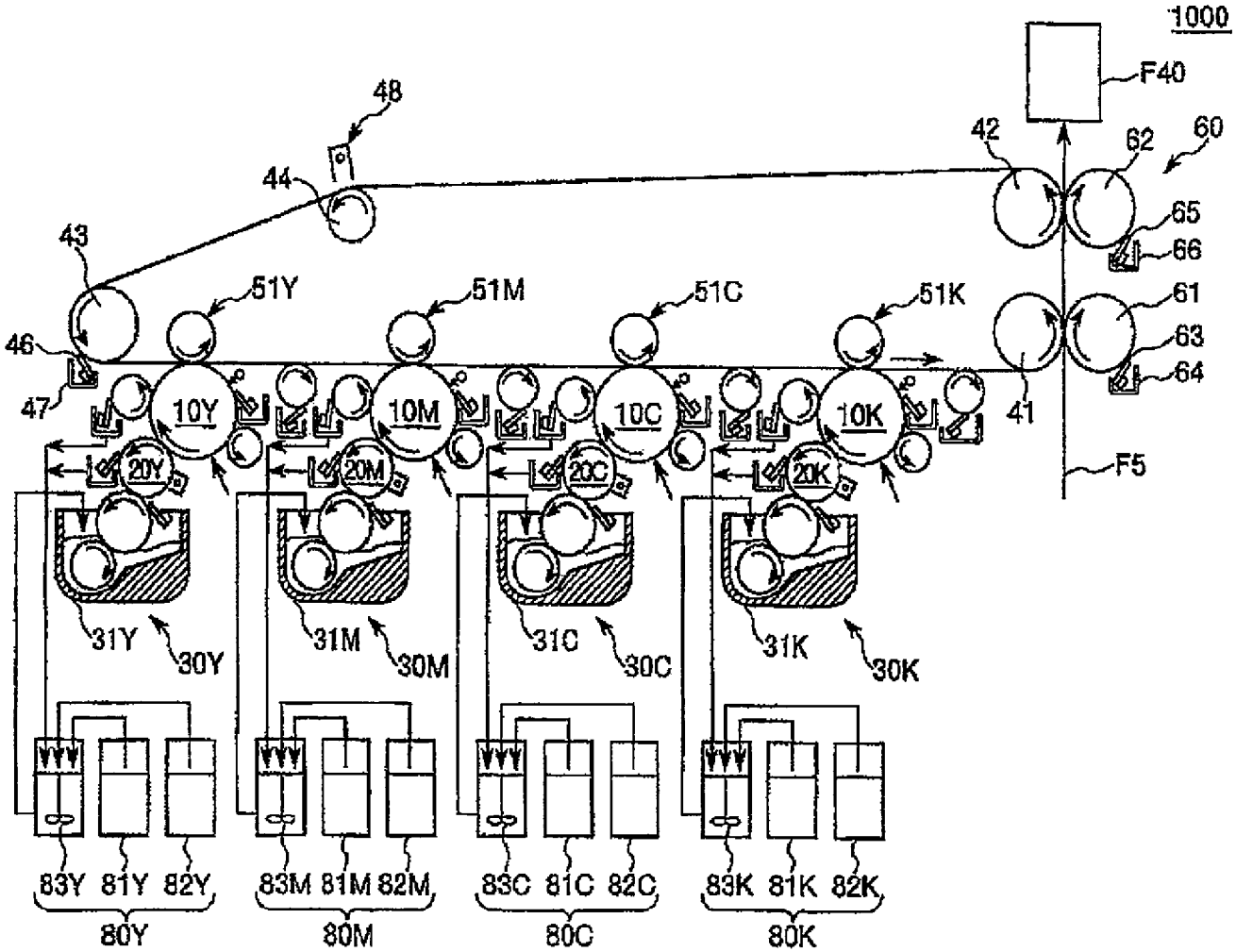
FIG. 1 is a schematic view which shows a preferred embodiment of an image forming apparatus that can use the liquid developer of the present invention.

Hereinbelow, with reference to the accompanying drawings, a preferred embodiment of a liquid developer and an image forming apparatus according to the present invention will be described in details.

Liquid Developer

First, a description will be made with regard to a liquid developer of the present invention.

The liquid developer of the present invention includes an insulation liquid, toner particles dispersed in the insulation liquid and a dispersant for improving dispersibility of the toner particles in the insulation liquid. The dispersant is consisted of a material having a predetermined amine value. Further, in the present invention, at least a part of the surface of each of the toner particles contains a rosin resin.

As described above, in the conventional liquid developers, in order to improve dispersibility of toner particles in an insulation liquid, it is attempted that a rosin resin having high affinity with the insulation liquid is used as a resin constituting the toner particles.

However, in such a conventional liquid developer, although the toner particles containing the rosin resin have good dispersibility in the insulation liquid at the early stage of the preservation of the liquid developer, aggregation of the toner particles is likely to occur during the preservation with the elapse of time. Therefore, there is a problem in that it is difficult to keep the good dispersibility of the toner particles in the insulation liquid for a long period of time. Further, there is another problem in that such toner particles used in the conventional liquid developer do not have sufficient charge property (in particular, positive charge property).

The present inventor has considered the problems described above and has made extensive researches and studies on the components of the liquid developer. As a result, the inventor has completed the present invention.

Namely, in the present invention, toner particles each containing a rosin resin in at least a part of the surface thereof and a dispersant being consisted of a material having a predetermined amine value are used as the components of the liquid developer.

Since the rosin resin has high affinity with the insulation liquid, it is possible to make the dispersibility of the toner particles in the insulation liquid sufficiently high. Further, since the rosin resin also has high affinity with the dispersant being consisted of a material having a predetermined amine value, it is possible to make the dispersant firmly adhere to the part of the surface of each of the toner particles where the rosin resin is exposed, and thus it is possible to prevent aggregation of the toner particles effectively. As a result, it is possible to make the dispersibility of the toner particles in the insulation liquid sufficiently high for a long period of time.

In addition, since the dispersant being consisted of a material having a predetermined amine value has positive charge property, each of the toner particles to which the dispersant firmly adheres to the surface thereof can have superior positive charge property.

As a result, it is possible to provide a liquid developer which has superior positive charge property as well as superior dispersibility of the toner particles for a long period of time. Further, since the liquid developer has the superior charge property and the superior dispersibility of the toner particles in the insulation liquid, the liquid developer can have superior developing efficiency and transferring efficiency and the like when used.

Hereinbelow, the components of the liquid developer according to the invention will be described in details.

Toner Particles

First, a description will be made with regard to the toner particles.

Constituent Material of Toner Particles (Toner Material)

The toner particles (toner) contained in the liquid developer of the present invention comprises at least a binder resin (resin material) and a coloring agent.

1 Resin Material (Binder Resin)

The toner particles contained in the liquid developer are constituted of a material which contains a resin material (binder resin) as its main component.

Further, in the present invention, at least a part of the surface of each of the toner particles contains a rosin resin.

As described above, the rosin resin has high affinity (high compatibility) with the insulation liquid. Therefore, the toner particles each containing the rosin resin in at least a part of the surface thereof can have high dispersibility in the insulation liquid.

Further, since the rosin resin also has high affinity with the dispersant having a predetermined amine value as described later, it is possible to make the dispersant firmly adhere to the part of the surface of each of the toner particles where the rosin resin is exposed.

Furthermore, the rosin resin is plasticized by the insulation liquid due to the high affinity between the rosin resin and the insulation liquid. Since the dispersant can adhere to the plasticized rosin resin more firmly than that which is not plasticized, it is possible to make the dispersant more firmly adhere to the part of the surface of each of the toner particles where the rosin resin is exposed.

This makes it possible to keep the dispersant adhering to the surfaces of the toner particles in the liquid developer for a long period of time. As a result, the liquid developer has superior dispersibility of the toner particles for a long period of time and superior positive charge property.

In this regard, it is to be noted that in the present invention, each of the toner particles contains the rosin resin in at least a part of the surface thereof. This means that each of the toner particles may contain the rosin resin in the localized area of the surface thereof or in the whole surface thereof. In the latter case, it is possible to make a larger amount of the dispersant adhere to the surface of each of the toner particles.

As a result, it is possible to make the dispersibility of the toner particles in the insulation liquid excellent for a long period of time. Further, it is also possible to make the charge property of the liquid developer excellent.

Examples of such a rosin resin include a rosin modified phenol resin, a rosin modified maleic acid resin, a rosin modified polyester resin, a fumaric acid modified rosin resin, an ester gum, and the like. These rosin resins may be used singly or in combination of two or more of them.

A softening point of the rosin resin described above is preferably in a range of 80 to 190° C., more preferably in a range of 80 to 160° C., and even more preferably in a range of 80 to 130° C.

If the softening point of the rosin resin constituting the toner particles is within the above range, during fixing process it is possible to reliably fix the toner particles onto a recording medium at a low temperature. Further, even if the liquid developer is exposed to a relatively high temperature, it is also possible to reliably prevent or suppress aggregation and fusion of the toner particles during the preservation of the liquid developer.

This makes it possible to make both the fixing characteristic of the toner particles to a recording medium and preservability or storage stability of the liquid developer sufficiently high while making the dispersibility of the toner particles in the insulation liquid excellent for a long period of time and making the charge property of the liquid developer excellent.

A weight-average molecular weight of the rosin resin is preferably in a range of 500 to 100,000, more preferably in a range of 1,000 to 80,000, and even more preferably in a range of 1,000 to 80,000.

If The weight-average molecular weight of the rosin resin constituting the toner particles is within the above range, during fixing process it is possible to reliably fix the toner particles onto a recording medium at a low temperature. Further, even if the liquid developer is exposed to a relatively high temperature, it is also possible to reliably prevent or suppress aggregation and fusion of the toner particles during the preservation of the liquid developer.

This makes it possible to make both the fixing characteristic of the toner particles to a recording medium and preservability or storage stability of the liquid developer sufficiently high while making the dispersibility of the toner particles in the insulation liquid excellent for a long period of time and making the charge property of the liquid developer excellent.

Acid values of the rosin resin are preferably 40 mgKOH/g or less, more preferably 30 mgKOH/g or less, and even more preferably 25 mgKOH/g or less. This makes it possible to make a larger amount of the dispersant adhere to the surface of each of the toner particles. As a result, the liquid developer can have superior dispersibility of the toner particles for a long period of time and superior positive charge property.

Further, in the resin material constituting the toner particles, an amount of the rosin resin is preferably in a range of 1 to 50 wt %, and more preferably in a range of 5 to 40 wt %. This makes it possible to make the rosin resin contained in the toner particle be present at the surface thereof more reliably. As a result, the liquid developer can have superior dispersibility of the toner particles for a long period of time and superior positive charge property.

Further, the toner particles may contain a known resin other than the rosin resin.

In particular, it is preferred that toner particles contain a resin having ester bonds in its chemical structure in addition to the rosin resin. Since there is a tendency that such a resin having ester bonds in its chemical structure has low compatibility with the rosin resin, it is possible to make the rosin resin contained in the toner particle be present at the surface thereof more reliably.

This makes it possible to make a larger amount of the dispersant adhere to the surface of each of the toner particles. As a result, the liquid developer has superior dispersibility of the toner particles for a long period of time and superior positive charge property. Further, this makes it possible to make preservability or storage stability of the liquid developer at a high temperature more excellent.

Examples of such a resin having the ester bonds in the chemical structure thereof include a polyester resin, a styrene-acrylate ester co-polymer, a methacrylic acid resin and the like. Among these materials mentioned above, the polyester resin is preferable due to its high transparency. Therefore, in the case where the polyester resin is also used as a binder resin, color development of an obtained image becomes excellent.

Further, since the polyester resin is a material that can easily control the balance of compatibility with the rosin resin, it is possible to easily form a phase separated structure or a dipping structure between the polyester resin and the rosin resin in each of the toner particles. As a result, it is possible to make the rosin resin contained in the toner particle be present at the surface thereof more effectively.

Furthermore, in the case where the toner particles contain the polyester resin as a resin material, it is preferable that the polyester resin contains a first polyester resin having a low molecular weight of which weight-average molecular weight $Mw_1$ is in a range of 3,000 to 12,000 and a second polyester resin having a high molecular weight of which weight-average molecular weight $Mw_2$ is in a range of 20,000 to 400,000.

This makes it possible to make the rosin resin contained in the toner particle be present at the surface thereof more reliably As a result, the liquid developer can have superior dispersibility of the toner particles for a long period of time and superior positive charge property. Further, it is possible to reliably prevent aggregation of the toner particles during preservation of the liquid developer. Further, it is also possible to fix the toner particles onto a recording medium at a relatively low temperature during the fixing process.

Further, it is preferred that the first polyester resin having a low molecular weight is synthesized from a monomer component which contains at least one of ethylene glycol (EG) and neo-penthyl glycol (NPG).

In this case, if an amount of the ethylene glycol in the monomer component is defined as W (EG) (wt %) and an amount of the neo-penthyl glycol in the monomer component is defined as W (NPG) (wt %), a weight ratio W (EG)/W (NPG) between the amounts of the ethylene glycol and the neo-penthyl glycol which are used in synthesizing the first polyester resin having a low molecular weight is preferably in a range of 0 to 1.1, and more preferably in a range of 0.8 to 1.0.

As a result, it is possible to reliably synthesize the first polyester resin having the low molecular weight. This makes it possible to exhibit superior preservability or storage stability of the toner particles sufficiently. Further, it is possible to reliably fix the toner particles onto a recording medium at a low temperature. Furthermore, such a liquid developer can be reliably used for forming images at a high speed.

A glass transition temperature $Tg_1$ of the first polyester resin is preferably in a range of 30 to 55° C., and more preferably in a range of 35 to 50° C. If the first polyester resin of which glass transition temperature $Tg_1$ falls within the above noted range is used as the resin material of the toner particles, it is possible to reliably prevent or suppress aggregation and fusion of the toner particles during the preservation of the liquid developer. As a result, it is possible to exhibit superior preservability or storage stability of the liquid developer. Furthermore, it is also possible to reliably fix the toner particles onto a recording medium at a low temperature.

A softening point $Tf_1$ of the first polyester resin is preferably in a range of 60 to 120° C., and more preferably in a range of 80 to 110° C. If the first polyester resin of which softening point $Tf_1$ falls within the above noted range is used as the resin material of the toner particles, it is possible to reliably prevent or suppress aggregation and fusion of the toner particles during the preservation of the liquid developer. As a result, it is possible to exhibit superior preservability or storage stability of the liquid developer. Further, during fixing process it is also possible to fuse the toner particles with a small amount of heat. This makes it possible to reliably fix the toner particles onto a recording medium at a low temperature. Furthermore, such a liquid developer can also be used for forming images at a high speed reliably.

In this specification, it is to be noted that the term "glass transition temperature $Tg_1$" means a temperature obtained as follows.

A sample, namely the first polyester resin is subjected to a differential scanning calorimetry apparatus DSC-220C (manufactured by Seiko Instruments Inc.) under conditions that a sample amount is 10 mg, a temperature raising speed is 10° C./min and a measurement temperature range is in a range of 10 to 150° C. to obtain a chart. Then, an extended line of a base line to the glass transition temperature in the obtained chart is crossed with a tangent which represents a maximal slop in a curve from a point at which a heat capacity of the sample suddenly changes in the chart to a vertex of a peak of the curve to obtain an intersection point of the tangent and the extended line. The glass transition temperature $Tg_1$ is a temperature at the intersection point.

In this regard, it is to be noted that this description can be applied to a glass transition temperature (Tg) of the polyester resin containing the first polyester resin and the second polyester resin and a glass transition temperature ($Tg_2$) of the second polyester resin as described below.

In this specification, the term "softening point" means a temperature at which softening is begun under the conditions that a temperature raising speed is 5° C./min and a diameter of a die hole is 1.0 mm in a high-floored flow tester (manufactured by Shimadzu Corporation).

Further, in the case where the toner particles contain the polyester resin as a constituent material thereof, an amount of the first polyester resin is preferably in a range of 50 to 90 wt %, and more preferably in a range of 60 to 80 wt %. Namely, the amount of the first polyester resin is larger than the amount of the second polyester resin. This makes it possible to exhibit superior fixing characteristics at a low temperature as well as superior preservability or storage stability of the liquid developer.

Further, it is preferred that the second polyester resin is synthesized from a monomer component which contains at least one of ethylene glycol (EG) and neo-penthyl glycol (NPG).

In this case, if an amount of the ethylene glycol in the monomer component is defined as W (EG) (wt %) and an amount of the neo-penthyl glycol in the monomer component is defined as W (NPG) (wt %), a weight ratio W (EG)/W (NPG) between the amounts of the ethylene glycol and the neo-penthyl glycol which are used in synthesizing the second polyester resin is preferably in a range of 1.2 to 3.0, and more preferably in a range of 1.5 to 2.0.

As a result, it is possible to reliably synthesize the second polyester resin having the high molecular weight as described above. This makes it possible to prevent aggregation of the toner particles reliably. As a result, it is possible for the liquid developer to exhibit superior preservability or storage stability. Further, it is also possible to reliably fix the toner particles onto a recording medium at a low temperature during the fixing process. Furthermore, it is possible to reliably improve both adhesion between the fixed toner particles and the recording medium and weather resistance. As a result, it is also possible to exhibit superior durability of the finally obtained toner images.

A glass transition temperature $Tg_2$ of the second polyester resin is preferably in a range of 45 to 70° C., and more preferably in a range of 50 to 65° C. If the second polyester resin of which glass transition temperature $Tg_2$ falls within the above noted range is used as the resin material of the toner particles, it is possible to reliably prevent or suppress aggregation and fusion of the toner particles during the preservation of the liquid developer. As a result, it is possible to exhibit superior preservability or storage stability of the liquid developer.

In particular, even if the liquid developer is preserved or stored at a high temperature, it is also possible to reliably prevent aggregation or fusion of the toner particles. As a result, it is also possible for the liquid developer to exhibit superior preservability or storage stability at a high temperature. Furthermore, it is also possible to reliably fix the toner particles onto a recording medium at a low temperature.

A softening point $Tf_2$ of the second polyester resin is preferably in a range of 60 to 220° C., and more preferably in a range of 80 to 190° C. If the second polyester resin of which softening point $Tf_2$ falls within the above noted range is used as the resin material of the toner particles, it is possible to prevent or suppress aggregation and fusion of the toner particles reliably during the preservation of the liquid developer. As a result, it is possible to exhibit superior preservability or storage stability of the liquid developer. Further, during fixing process it is possible to fix the toner particles onto a recording medium at a low temperature more firmly.

A glass transition temperature Tg of the polyester resin containing both the first polyester resin and the second polyester resin as described above is preferably in a range of 35 to 60° C., and more preferably in a range of 40 to 50° C.

If the polyester resin of which glass transition temperature Tg falls within the above noted range is used as a constituent material of the toner particles, it is possible to reliably prevent or suppress aggregation and fusion of the toner particles during the preservation of the liquid developer. As a result, it is possible to exhibit superior preservability or storage stability of the liquid developer. Further, it is also possible to fix the toner particles onto a recording medium at a low temperature more reliably.

Furthermore, in the case where the toner particles contain the polyester resin as a constituent material thereof, an amount of the polyester resin is preferably in a range of 10 to 50 wt %, and more preferably in a range of 20 to 40 wt %. This makes it possible to exhibit superior preservability or storage stability of the liquid developer. Further, it is also possible to exhibit superior fixing characteristics at a low temperature.

Acid values of the resin material other than the rosin resin are preferably in a range of 5 to 20 mgKOH/g, and more preferably in a range of 5 to 15 mgKOH/g. This makes it possible to make the rosin resin contained in the toner particle be present at the surface thereof more reliably. As a result, since it is possible to make a larger amount of the dispersant adhere to the surface of each of the toner particles more effectively, the liquid developer can have superior dispersibility of the toner particles for a long period of time and superior positive charge property.

A softening point of the resin material other than both the rosin resin and the polyester resin is preferably in a range of 50 to 130° C., more preferably in a range of 50 to 120° C., and even more preferably in a range of 60 to 115° C. This makes it possible to make fixing characteristic of the toner particles excellent.

2 Coloring Agent

The toner particles of the liquid developer contains a coloring agent in addition to the resin material. As for a coloring agent, it is not particularly limited, but known pigments, dyes or the like can be used.

3 Other Components

In the toner particles, additional components other than the above components may be contained. Examples of such other components include wax, magnetic powder, and the like.

Further, the toner material (constituent material of the toner particles) may further contain zinc stearate, zinc oxide, cerium oxide, silica, titanium oxide, iron oxide, fatty acid, or fatty acid metal salt, or the like in addition to the components described above.

Shape of Toner Particles

The average particle size (diameter) of the toner particles constituted from the above described materials is preferably in a range of 0.5 to 3 μm, more preferably in a range of 1 to 2.5 μm, and even more preferably in a range of 1 to 2 μm.

If the average particle size of the toner particles is within the above range, it is possible to make variation in the properties of the toner particles small. As a result, it is possible to make resolution of a toner image formed from the liquid developer (liquid toner) sufficiently high while making the reliability of the obtained liquid developer as a whole sufficiently high.

Further, it is also possible to improve dispersibility of the toner particles in the liquid developer to a satisfactory level, thereby making the preservability or storage stability of the liquid developer excellent.

An amount of the toner particles contained in the liquid developer is preferably in a range of 10 to 60 wt %, and more preferably in a range of 20 to 50 wt %.

Dispersant

Hereinbelow, a description will be made with regard to the dispersant.

The liquid developer of the present invention includes the dispersant consisted of a material having a predetermined amine value.

In the meantime, in general, the rosin resin described above and other resin which are used as a resin material constituting the toner particles have negative charge property.

Conventionally, in the case where such a resin having negative charge property is used as a resin material constituting toner particles contained in a liquid developer, it is difficult to allow the toner particles (the liquid developer) to be charged positively. Further, even if a charge control agent is added to the liquid developer in order to allow the toner particles to be charged positively, it is difficult to obtain toner particles which are positively charged in a sufficient level.

Further, it may be conceived that a resin having positive charge property is used as the resin material constituting toner particles contained in a liquid developer, but the resin having positive charge property is difficult to use as the resin material constituting the toner particles due to low stability thereof.

On the other hand, in the case where the dispersant being consisted of a material having a predetermined amine value is contained in the liquid developer like the present invention, it is possible to obtain the following effects.

Namely, since the rosin resin described above generally has a high acid value, the material constituting the dispersant has high affinity (compatibility) with the rosin resin having such a high acid value. Therefore, in the case where the rosin resin contained in each of the toner particles is present at the surface thereof, it is possible to make the dispersant firmly adhere to the surface of the toner particle in the liquid developer for a long period of time. As a result, the liquid developer has superior dispersibility of the toner particles for a long period of time.

Further, in the image forming apparatus described later that can use the liquid developer of the present invention, it is possible to reuse the liquid developer collected in the developing section and the like easily due to the superior dispersibility of the toner particles in the insulation liquid.

In addition, the material constituting the dispersant has nitrogen atoms of amine groups or amide groups in its chemical structure. Since the nitrogen atoms draw the proton (H+) which is liberated from acidic groups and the like in the chemical structures of the resin materials of the toner particles, it is possible to make the dispersant firmly adhere to the surface of each of the toner particles in the liquid developer. As a result, it is possible to allow the toner particles to be charged positively when used in the image forming apparatus because the dispersant has positive charge property.

Further, since the material constituting the dispersant has high affinity with the insulation liquid, it is possible to make the dispersibility of the toner particles in the insulation liquid sufficiently high due to the dispersant adhering to the surfaces thereof.

In the liquid developer of the present invention, by using both the toner particles containing the rosin resin and the dispersant being consisted of a material having a predetermined amine value, the liquid developer can have superior dispersibility of the toner particles for a long period of time and superior positive charge property. Further, since the liquid developer has the superior charge property and the superior dispersibility of the toner particles for a long period of time, the liquid developer can have superior developing efficiency and transferring efficiency and the like.

It is preferred that the material constituting the dispersant has at least one of secondary amine groups, tertiary amine groups and amide bonds in its chemical structure. The material having at least one of the chemical structures described above has high basic property. Therefore, the dispersant has superior affinity with the rosin resin having acidic property. This makes it possible to make the dispersant more firmly adhere to the part of the surface of each of the toner particles where the rosin resin is exposed. As a result, the liquid developer can have superior dispersibility of the toner particles for a long period of time and superior positive charge property.

Further, the predetermined amine value of the material constituting the dispersant is preferably in a range of 1 to 100 mgKOH/g, and more preferably in a range of 10 to 80 mgKOH/g. If the predetermined amine value of the material is within the above range, the dispersant has sufficiently high positive charge property and superior affinity with the rosin resin which is contained in the toner particle. This makes it possible to allow the toner particles to be reliably charged positively, and this also makes it possible to make the dispersibility of the toner particles in the insulation liquid more excellent.

On the other hand, if the predetermined amine value of the material constituting the dispersant as described above is smaller than the lower limit value described above, the toner particles may not obtain sufficient positive charge property because the material constituting the dispersant does not have sufficient positive charge property.

Further, if the predetermined amine value of the material constituting the dispersant as described above exceeds the upper limit value described above, each of particles of the dispersant becomes aggregated in the liquid developer. As a result, the toner particles may not obtain sufficient dispersibility in the insulation liquid.

Examples of such a material constituting the dispersant include EFKA-5044, EFKA-5244, EFKA-6220, EFKA-6225, EFKA-7564, EFKA-4080 (produced by Chiba Specialty Chemical Co.), Anti-Terra-U, Disperbyk-101, Disperbyk-106, Disperbyk-108, Disperbyk-109, Disperbyk-116, Disperbyk-140 (produced by BYK Japan KK, where "Disperbyk" is the registered trademark), Agrisperse FA, Agrisperse 712 (produced by New Century Coat Co.), and the like. These materials may be used singly or in combination of two or more of them as the material constituting the dispersant.

Further, in the liquid developer, an amount of the dispersant is preferably in a range of 0.2 to 10 parts by weight with respect to 100 parts by weight of the toner particles, more preferably in a range of 1 to 8 parts by weight, and even more preferably in a range of 3 to 6 parts by weight.

If the amount of the dispersant in the liquid developer is within the above range, it is possible to make a sufficient amount of the dispersant adhere to the surfaces of the toner particles. This makes it possible to improve the dispersibility of the toner particles in the insulation liquid effectively, and this also makes it possible to make positive charge characteristic of the toner particles excellent.

Insulation Liquid

Hereinbelow, a description will be made with regard to the insulation liquid.

In the present invention, various insulation liquids can be used if they have sufficiently high insulation properties. In more details, the electric resistance of such insulation liquids as described above at room temperature (20° C.) is preferably equal to or higher than $1\times10^{9}$ Ωcm, more preferably equal to or higher than $1\times10^{11}$ Ωcm, and even more preferably equal to or higher than $1\times10^{13}$ Ωcm.

Further, the dielectric constant of the insulation liquids is preferably equal to or lower than 3.5.

Examples of the insulation liquids that satisfy these conditions include: an mineral oil such as ISOPAR E, ISOPAR G, ISOPAR H, ISOPAR L ("ISOPAR" is a product name of Exxon Mobil), SHELLSOL 70, SHELLSOL 71 ("SHELLSOL" is a product name of Shell Oil), Amsco OMS, Amsco 460 solvent ("Amsco" is a product name of Spirit Co., Ltd.), low-viscosity or high-viscosity liquid paraffin (Wako Pure Chemical Industries, Ltd.), and the like; fatty acid ester or vegetable oil which contains the fatty acid ester such as fatty acid glyceride, fatty acid monoester, medium fatty acid ester, and the like; octane, isooctane, decane, isodecane, decaline, nonane, dodecane, isodecane, cyclohexane, cyclooctane, cyclodecane, benzene, toluene, xylene, mesitylene, and the like. These insulation liquids may be used singly or in combination of two or more of them.

Among the above-mentioned insulation liquids, vegetable oil is preferably used, since vegetable oil has superior affinity (compatibility) with both the rosin resin and the dispersant described above. Therefore, use of such vegetable oil as the insulation liquid makes it possible to improve the dispersibility of the toner particles in the insulation liquid.

Further, the liquid developer (insulation liquid) may further contain antioxidant and charge control agent.

The viscosity of the insulation liquid is not particularly limited, but it is preferably in a range of 5 to 1000 mPa·s, more preferably in a range of 50 to 800 mPa·s, and even more preferably in a range of 50 to 500 mPa·s.

If the viscosity of the insulation liquid falls within the above range, in the case where the liquid developer is dipped from a developer container by an application roller in an image forming apparatus, an appropriate amount of the insulation liquid can adhere to the surfaces of the toner particles. As a result, the liquid developer can have superior developing efficiency and transferring efficiency and the like.

Further, this makes it possible to prevent aggregation or settling of the toner particles efficiently. As a result, it is possible to make dispersibility of the toner particles in the insulation liquid higher. Furthermore, in the image forming apparatus, it is possible to supply the liquid developer to the application roller more uniformly as well as to prevent dripping of the liquid developer due to an appropriate viscosity of the liquid developer.

On the other hand, if the viscosity of the insulation liquid as described above is smaller than the lower limit value described above, there is a possibility that dripping of the liquid developer and the like occurs in the image forming apparatus.

Further, if the viscosity of the insulation liquid as described above exceeds the upper limit value described above, there is a case that sufficient dispersibility of the toner particles can not be obtained in the insulation liquid. As a result, there is a case that it is not possible to supply the liquid developer to the application roller uniformly in the image forming apparatus as described later.

In this regard, it is to be noted that in this specification, the viscosity of the insulation liquid is measured at a temperature of 25° C.

Method of Producing Liquid Developer

Hereinbelow, a preferred embodiment of a method of producing a liquid developer of the present invention will be described.

The method of producing the liquid developer in this embodiment includes a step of preparing a dispersion liquid comprised of a water-based dispersion medium constituted of a water-based liquid and a dispersoid in the form of finely divided particles comprised of a resin material and a coloring agent described above. The dispersoid is dispersed in the water-based dispersion medium.

The method further includes an associated particle formation step of associating a plurality of particles of the dispersoid in the water-based dispersion to obtain the associated particles dispersed in an associated particle dispersion liquid.

The method further includes a step of removing a liquid (solvent) contained in the associated particle dispersion liquid to obtain toner particles comprised of the resin material and the coloring agent.

The method further includes a dispersion step of dispersing the thus obtained toner particles and a dispersant similar to that as described above in an insulation liquid.

Hereinbelow, each of the steps of the method of producing the liquid developer of this embodiment will be described in detail.

Step of Preparing Dispersion Liquid (Step of Preparing Water-Based Dispersion Liquid)

First, a dispersion liquid (water-based dispersion liquid) is produced as described below.

Such a method of production of the water-based dispersion liquid is not particularly limited. An example of such a method is described hereinbelow.

First, a resin solution containing an organic solvent and a constituent material constituting toner particles (toner material) which is a resin material (a rosin resin and a resin other than the rosin resin), a coloring agent and the like is obtained by dissolving or dispersing the constituent material constituting the toner particles in the organic solvent (Preparation of Resin Solution).

Thereafter, a water-based liquid is added to the resin solution described above. As a result, it is possible to obtain the water-based dispersion comprised of the water-based liquid (water-based dispersion medium) and a dispersoid comprised of the constituent material constituting toner particles in the form of fine particles which is dispersed in the water-based liquid (Formation of Dispersoid).

Preparation of Resin Solution

First, the constituent material constituting the toner particles, which contains the resin material (the rosin resin and the resin other than the rosin resin) is dissolved and/or dispersing in an organic solvent. As a result, the resin solution containing the organic solvent and the constituent material is obtained.

The resin solution contains the constituent material constituting the toner particles and the organic solvent as follow.

Various organic solvents may be employed if they can dissolve a part of the resin material constituting the toner particles, but it is preferable to use an organic solvent having a boiling point lower than that of the water-based liquid. This makes it possible to remove the solvent from the dispersoid easily.

Further, it is also preferred that the organic solvent has low compatibility with the water-based dispersion liquid (for example, a liquid having a solubility of 30 g or lower with respect to the water-based liquid of 100 g at 25° C.). This makes it possible for the toner material to be finely dispersed in the water-based dispersion in a stable manner.

Further, a composition of the organic solvent can be selected appropriately according to the resin material described above, the composition of the coloring agent to be used, the composition of the water-based dispersion liquid to be used or the like.

Such an organic solvent is not particularly limited to any specific kinds of solvent. Examples of such an organic solvent include ketone solvent such as methyl ethyl ketone (MEK), aromatic hydrocarbon solvent such as toluene, and the like.

Such a resin liquid can be obtained by mixing the resin material, the coloring agent, the organic solvent and the like with being stirred with an agitator and the like. Examples of such an agitator include high speed agitators such as DESPA (produced by ASADA IRON WORKS. CO., LTD), T.K. ROBOMIX/T.K. HOMO DISPER MODEL 2.5 (produced by PRIMIX Corporation).

Further, the temperature of the components constituting the resin liquid in stirring the components with the agitator is preferably in a range of 20 to 60° C., and more preferably in a range of 30 to 50° C.

An amount of the solid component contained in the resin solution is not particularly limited, but it is preferably in a range of 40 to 75 wt %, more preferably in a range of 50 to 73 wt % and even more preferably in a range of 50 to 70 wt %. This makes it possible to increase the degree of sphericity of the fine particles of the dispersoid in the water-based dispersion. Namely, it is possible to form the shape of the dispersoid into an approximately spherical shape. As a result, the toner particles in the finally obtained liquid developer can have especially large roundness and especially small particle shape variation so that the toner particles are preferably used in a liquid developer.

Further, in the preparation of the resin solution, the all components constituting the resin solution may be mixed at the same time. Furthermore, a part of the components constituting the resin solution is mixed thereby to obtain a mixture (master). Thereafter, the mixture may be mixed with the other components thereof.

Formation of Dispersoid

Next, a water-based dispersion liquid constituted from a water-based liquid is added to the resin solution described above. As a result, a dispersoid comprised of fine particles of the toner material described above is formed in the water-based dispersion liquid so that a water-based dispersion (a water-based emulsion) in which the dispersoid is dispersed is obtained.

In this embodiment, the water-based dispersion liquid is constituted from a water-based liquid.

As a water-based liquid, a liquid constituted from water as a major component thereof can be used.

Further, the water-based liquid may contain a solvent having good compatibility with water (for example, a solvent having a solubility of 50 g or higher with respect to water of 100 g at 25° C.).

Furthermore, in preparing the water-based emulsion, an emulsion dispersant may be added to the water-based dispersion liquid. By adding the emulsion dispersant to the water-based dispersion liquid in preparing the water-based emulsion, it is possible to produce the water-based emulsion more easily.

Such an emulsion dispersant is not particularly limited, but commonly used emulsion dispersants can be used.

Further, the water-based emulsion may contain a neutralizing agent. By containing the neutralizing agent in the water-based emulsion in preparing the water-based emulsion, the neutralizing agent neutralizes functional groups (for example, a carboxyl group) contained in a resin material constituting the toner particles. As a result, it is possible to improve the dispersibility of the dispersoid. Further, it is also possible to make variations in shape and size of the dispersoid in the water-based emulsion smaller, and also possible to make particle size distribution of the toner particles finally obtained especially narrow.

The neutralizing agent may be added to the water-based dispersion liquid. Further, the neutralizing agent may be added to the resin liquid. Furthermore, in preparing the water-based emulsion, the neutralizing agent may be added to the water-based dispersion liquid at different timings.

As for the neutralizing agent, a basic compound may be used. More specifically, examples of such a neutralizing agent include: inorganic base such as sodium hydroxide, potassium hydroxide, ammonia, and the like; organic base such as diethylamine, triethylamine, isopropylamine, and the like. These neutralizing agents may be used singly or in combination of two or more of them. Further, the neutralizing agent may be consisted of aqueous solution containing the compounds described above.

Further, in the case where the water-based emulsion contains the basic compound as the neutralizing agent, an amount of using the basic compound is preferably in a range of 1 to 3 times equivalent amount of the basic compound which is necessary to neutralize all the carboxyl groups contained in the resin material in the water-based emulsion, and more preferably in a range of 1 to 2 times equivalent amount of the basic compound. This makes it possible to make the shape of each particles of the dispersoid uniform. Further, this also makes it possible to narrow particle size distribution of the toner particles finally obtained.

Such a method of adding the water-based liquid to the resin solution is not particularly limited, but it is preferred that the water-based liquid containing water is added to the resin solution with being stirred. More specifically, it is preferred that the water-based liquid is added drop by drop to the resin solution with the resin solution being stirred by an agitator and the like thereby to induce phase-inversion from a water-in-oil type emulsified liquid to an oil-in-water type emulsified liquid. As a result, the water-based emulsion in which the dispersoid derived from the resin liquid is dispersed in the water-based liquid (the water-based dispersion liquid) is finally obtained.

Examples of such an agitator for stirring the resin solution include high speed agitators such as DESPA (produced by ASADA IRON WORKS. CO., LTD), T.K. ROBOMIX/T.K. HOMO DISPER MODEL 2.5 (produced by PRIMIX Corporation), CAVITRON (produced by MITUI MINING. CO., LTD), Slasher (produced by EUROTECH, LTD) and the like, or high speed dispersers.

Further, in adding the water-based liquid to the resin solution, a rotational velocity of the tip of a stirring blade of the agitator described above is preferably in a range of 10 to 20 m/sec, and more preferably in a range of 12 to 18 m/sec. This makes it possible to produce the water-based emulsion efficiently. Further, it is also possible to make variations in shape and size of the dispersoid in the water-based emulsion especially small. Furthermore, it is also possible to prevent the dispersoid in the water-based emulsion from being formed into excessively fine particles or coarsened particles, and also possible to improve the dispersibility of the dispersoid.

An amount of the solid component contained in the water-based emulsion is not particularly limited, but it is preferably in a range of 5 to 55 wt %, and more preferably in a range of 10 to 50 wt %. This makes it possible to prevent bonding or aggregation of the dispersoid in the water-based emulsion more reliably, thereby enabling productivity of the toner particles (liquid developer) to be especially excellent.

Further, the temperature of the components constituting the water-based emulsion in stirring the components with the agitator is preferably in a range of 20 to 60° C., and more preferably in a range of 20 to 50° C.

Associated Particle Formation Step

Next, a plurality of the fine particles of the dispersoid in the water-based emulsion are associated so that associated particles dispersed in an associated particle dispersion liquid is obtained (Associated particle formation). Association of the fine particles of dispersoid is generally carried out by allowing fine particles of the dispersoid containing organic solvent conflicting with each other and thereby each of the dispersoid being integrated. In this process of associating of the dispersoid, since there is a tendency that a rosin resin described above has low compatibility with a resin other than the rosin resin, it is possible to make a phase separated structure between the polyester resin and the rosin resin formed. As a result, it is possible to make the rosin resin contained in the associated particle be present at the surface thereof and also possible to make the rosin resin contained in the toner particle finally obtained be present at the surface thereof.

The association of a plurality of the dispersoid is carried out by adding an electrolyte to the water-based emulsion obtained by the processes as described above with being stirred. This makes it possible to obtain the associated particles easily and reliably. Further, by controlling an additive amount of the electrolyte into the water-based emulsion, it is possible to control a particle size and a particle size distribution of the associated particles easily and reliably.

Such an electrolyte is not particularly limited to any specific kinds of electrolyte, but organic or inorganic soluble salts may be used singly or in combination of two or more of them.

Further, it is preferred that such an electrolyte is salts of monovalent cation. This makes it possible to make particle size distribution of the associated particles narrow. Further, it is possible to prevent coarsened particles from being produced in the process of associating the fine particles of the dispersoid.

Among the above-mentioned electrolytes, sulfate salts such as sodium sulfate, ammonium sulfate and the like, and carbonate are preferably used as the electrolyte, and the sulfate salts are especially preferably used. This makes it possible to control a particle size of the associated particles especially easily.

An amount of the electrolyte to be added is preferably in a range of 0.5 to 3 parts by weight, more preferably in a range of 1 to 2 parts by weight with respect to 100 parts by weight of solid components of the water-based emulsion. This makes it possible to control a particle size of the associated particles more reliably. Further, it is possible to also prevent production of coarsened particles reliably.

Further, it is preferred that a solution of the electrolyte is added to the water-based emulsion. This makes it possible to make the electrolyte diffuse in the whole water-based emulsion quickly. Furthermore, it is also possible to control the amount of the electrolyte to be added to the water-based emulsion easily and reliably. As a result, it is possible to obtain the associated particles having a desired particle size and especially narrow particle size distribution.

Further, in the case where the solution of the electrolyte is added to the water-based emulsion, concentration of the electrolyte with respect to the solution is preferably in a range of 2 to 10 wt %, and more preferably in a range of 2.5 to 6 wt %. This makes it possible to make the electrolyte diffuse in the whole water-based emulsion especially quickly. Furthermore, it is also possible to control the amount of the electrolyte to be added to the water-based emulsion easily and reliably. In addition, the amount of water in the water-based emulsion after adding the solution of the electrolyte can be adjusted appropriately. As a result, a growth rate of the associated particles can be appropriately adjusted to be slow without lowering the productivity. This makes it possible to control a particle size of the associated particles more reliably. Further, it is also possible to prevent coarsened particles from being produced in the water-based emulsion.

Further, in the case where the solution of the electrolyte is added to the water-based emulsion, a rate of adding the solution of the electrolyte to the water-based emulsion is preferably in a range of 0.5 to 10 parts by weight/min, more preferably in a range of 1.5 to 5 parts by weight/min with respect to 100 parts by weight of the solid components of the water-based emulsion. This makes it possible to prevent the concentration of the electrolyte in the whole water-based emulsion from being inhomogeneous. As a result, it is possible to prevent production of coarsened particles reliably.

Further, this makes it possible to control the growth rate of the associated particles more appropriately. As a result, it is possible to control an average particle size of the associated particles more reliably, thereby enabling the productivity of the toner particles (liquid developer) to be especially excellent.

Further, the electrolyte may be added to the water-based emulsion at different timings. This makes it possible to obtain associated particles having a desired particle size and large roundness (sphericity) reliably.

Further, in the step of forming the associated particles, the associated particles in the associated particle dispersion liquid are produced in a state that the water-based emulsion being stirred by an agitator. This makes it possible to make variations in shape and size of the associated particles in the associated particle dispersion liquid especially small.

Such an agitator for stirring the associated particle dispersion liquid may be equipped with a stirring blade. Examples of such a stirring blade include anchor type stirring blade, turbine blade, Pfaudler blade, FULLZONE impeller, maxblend stirring blade, and semi-lunar blade. Among the above-mentioned stirring blades, maxblend stirring blade and FULLZONE impeller are preferably used as a stirring blade. This makes it possible to make the electrolyte disperse and dissolve in the water-based emulsion (the associated particle dispersion liquid) more quickly and more homogeneously.

Namely, this makes it possible to prevent the concentration of the electrolyte in the water-based emulsion from being inhomogeneous reliably. Further, this makes it possible to make the dispersoid in the water-based emulsion associated efficiently. Furthermore, it is possible to prevent the associated particles that have been already formed from being collapsed more reliably. As a result, it is possible to obtain associated particles having small variations in shape and size thereof efficiently.

In the step of forming the associated particles, a rotational velocity of the tip of the stirring blade of the agitator described above is preferably in a range of 0.1 to 10 m/sec, and more preferably in a range of 0.2 to 8 m/sec. This makes it possible to make the electrolyte disperse and dissolve in the water-based emulsion (the associated particle dispersion liquid) more quickly and more homogeneously. Namely, this makes it possible to prevent the concentration of the electrolyte in the water-based emulsion from being inhomogeneous reliably. Further, it is possible to prevent the associated particles that have been already formed from being collapsed more reliably.

An average particle size of the obtained associated particles is preferably in a range of 0.5 to 5 μm, and more preferably in a range of 1.5 to 3 μm. This enables the toner particles finally obtained to have an appropriate particle size.

Step of Removing Solvent in Associated Particle Dispersion Liquid

Next, the organic solvent contained in the associated particle dispersion liquid is removed. This makes it possible to obtain resin fine particles (toner particles) constituted of the toner material. As a result, each of the toner particles obtained in this way has a surface in which at least a part thereof contains the rosin resin.

Such a method of removing the organic solvent in the associated particle dispersion liquid is not particularly limited, but for example, it may be carried out by drying the associated particle dispersion liquid under reduced pressure. This makes it possible to prevent the constituent material of the toner particles (that is the resin material) from denaturing sufficiently and also makes it possible to remove the organic solvent efficiently.

Further, a temperature to remove the organic solvent contained in the associated particle dispersion liquid is preferably lower than a glass transition temperature (Tg) of the resin material.

Further, in this step of removing the organic solvent contained in the associated particle dispersion liquid, an antifoaming agent may be added to the associated particle dispersion liquid. This makes it possible to remove the organic solvent efficiently.

Examples of an antifoaming agent include mineral oil type antifoaming agent, polyether type antifoaming agent, and silicone type antifoaming agent, lower alcohol, higher alcohol, fat, fatty acid, fatty acid ester, ester phosphate and the like.

An amount of the antifoaming agent to be added is not particularly limited, but an amount of the antifoaming agent is preferably in a range of 20 to 300 ppm, more preferably in a range of 30 to 100 ppm with respect to the solid component contained in the associated particle dispersion liquid.

Further, in this step of removing the organic solvent contained in the associated particle dispersion liquid, a part of the water-based liquid may be removed together with the organic solvent.

In this regard, in this step of removing the organic solvent contained in the associated particle dispersion liquid, a part of the organic solvent may remain in the associated particle dispersion liquid. Even if in this step, a part of the organic solvent remains in the associated particle dispersion liquid, the organic solvent contained in the associated particle dispersion liquid is completely removed in the later step.

Step of Washing

Next, the resin fine particles constituted of the toner material obtained as described above are washed (Step of washing).

By carrying out the step of washing the toner particles, even if the resin fine particles contain the organic solvent, which has not yet been removed in the previous step, and the like as impurities, the organic solvent and the like contained in the resin fine particles is completely removed in this step. As a result, the toner particles finally obtained have an especially small amount of total volatile organic compounds (TVOC).

Such a method of washing the toner particles is carried out as follow. First, the slurry mainly containing the resin fine particles and the water-based liquid is separated into a solid content (the resin fine particles) and a liquid content. Thereafter, the solid content separated from the slurry is dispersed into water to thereby obtain new slurry (redispersion step). Further, once more, the thus obtained slurry is separated into a solid content (the resin fine particles) and a liquid content. Further, the separation step and the redispersion step may be repeated more than once.

Step of Drying

Thereafter, the resin fine particles constituted of the toner material washed as described above are dried to thereby obtain toner particles (step of drying).

In this step of drying the resin fine particles, such resin fine particles can be dried by a drying machine. Examples of such a drying machine include a vacuum drier (for example, "Ribocone" produced by Okawara Manufacturing, "Vrieco-Nauta Mixer NXV Vacuum" produced by HOSOKAWA MICRON CORPORATION, and the like), a fluid-bed drier (produced by OKAWARA MFG. Co., Ltd), and the like.

Dispersion Step Next, the thus obtained toner particles and a dispersant described above are dispersed in an insulation liquid. As a result, the liquid developer of the present invention is obtained (dispersion step).

Such a method of dispersing the toner particles and the dispersant in the insulation liquid is not particularly limited, but for example, it may be carried out by mixing all the toner particles, the dispersant, and the insulation liquid with bead mill, ball mill, and the like. This makes it possible to make the dispersant described above adhere to the toner particles more reliably.

Further, in this step of dispersing the toner particles and the dispersant in the insulation liquid, additional components constituting the liquid developer other than the toner particles, the dispersant, and the insulation liquid may be mixed together.

Further, in this step of dispersing the toner particles and the dispersant in the insulation liquid, the toner particles and the dispersant may be dispersed in the whole of the insulation liquid used in the liquid developer. Alternatively, the toner particles and the dispersant may be dispersed in a part of the insulation liquid used in the liquid developer.

In the case where the toner particles and the dispersant are dispersed in a part of the insulation liquid used in the liquid developer, the remaining insulation liquid to be added after dispersion of the toner particles and the dispersant may be the same kind of the insulation liquid that has been already used. Alternatively, the remaining insulation liquid to be added after dispersion of the toner particles and the dispersant may be a different kind of the insulation liquid that has been already used. In the latter case, it is possible to control the physical characteristics such as viscosity of the liquid developer finally obtained easily.

By using the method of producing the liquid developer as described above, it is possible to obtain the toner particles each having a surface in which at least a part thereof contains the rosin resin. Further, this makes it possible to make variations in shape and size of the toner particles in the liquid developer small. As a result, since the surface area of each of the toner particles is uniform among the toner particles, it is possible to make the dispersant described above adhere to the surfaces of the toner particles uniformly. This makes it possible to make the dispersibility of the toner particles in the insulation liquid excellent for a long period of time and also makes it possible to suppress variation of the charge property among the toner particles efficiently. Further, this also makes it possible to obtain the liquid developer having excellent developing efficiency and transferring efficiency.

Image Forming Apparatus

Next, a description will be made with regard to a preferred embodiment of an image forming apparatus of the present invention. The image forming apparatus of the present invention is an apparatus which forms color images on a recording medium by using the liquid developer of the present invention as described above.

Figure 2:
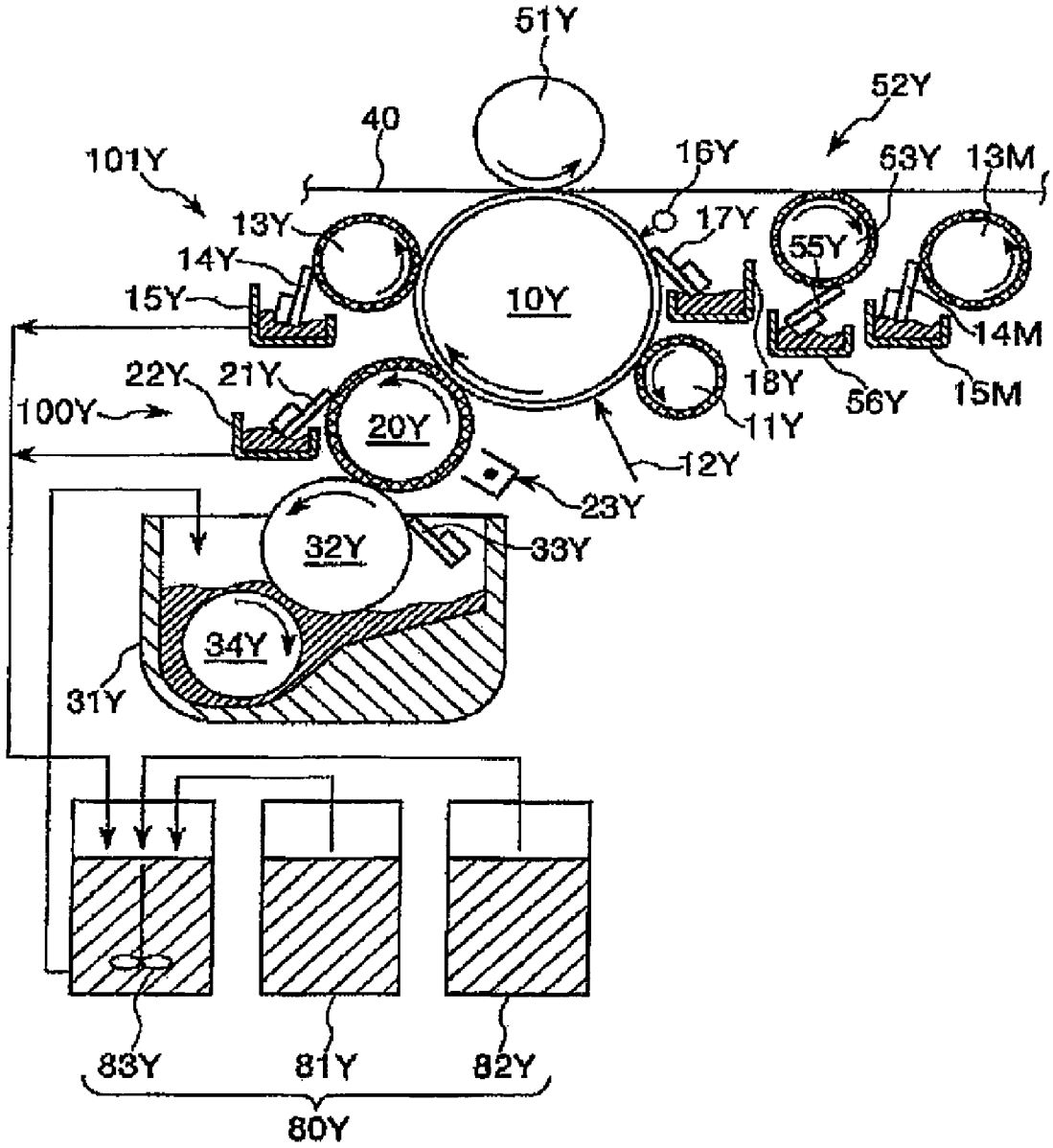
FIG. 2 is an enlarged view of a part of the image forming apparatus shown in FIG. 1.
Figure 3:
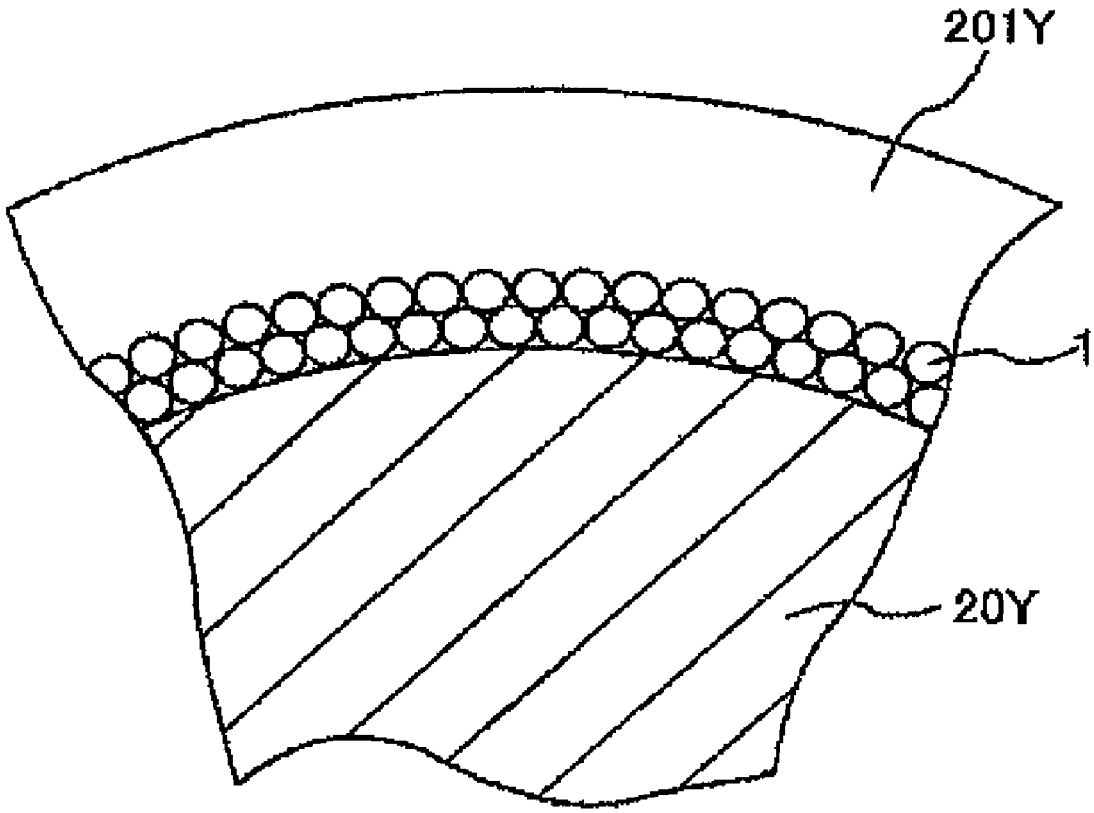
FIG. 3 is a schematic view which shows a state of toner particles in a layer of the liquid developer on a developing roller of the image forming apparatus shown in FIG. 1.
Figure 4:
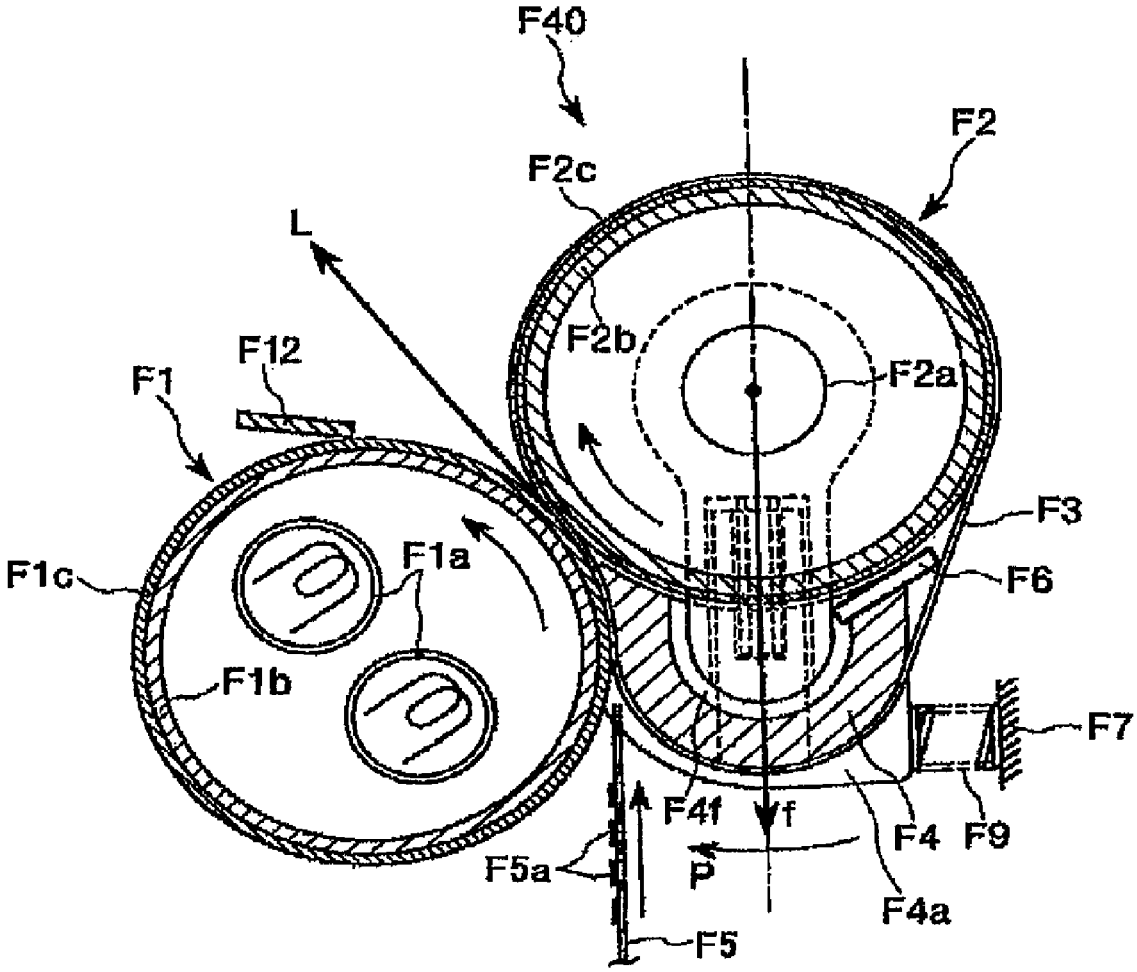
FIG. 4 is a cross-sectional view which shows one example of a fixing unit provided in the image forming apparatus shown in FIG. 1.

FIG. 1 is a schematic view which shows a preferred embodiment of an image forming apparatus to which the liquid developer of the present invention can be used. FIG. 2 is an enlarged view of a part of the image forming apparatus shown in FIG. 1. FIG. 3 is a schematic view which shows a state of toner particles in a layer of the liquid developer on the development roller. FIG. 4 is a cross-sectional view which shows one example of a fixing unit provided in the image forming apparatus shown in FIG. 1.

As shown in FIG. 1 and FIG. 2, the image forming apparatus 1000 includes four developing sections comprised of 30Y, 30C, 30M and 30K, an intermediate transfer section 40, a secondary transfer unit (secondary transfer section) 60, a fixing section (fixing unit) F40 used in the first embodiment of the image forming apparatus and four liquid developer supply sections 80Y, 80M, 80C and 80K.

The developing sections 30Y, 30C and 30M include respectively a yellow (Y) liquid developer, a cyan (C) liquid developer, and a magenta (M) liquid developer, and have the functions of developing latent images with the liquid developers to form monochromatic color images corresponding to the respective colors. Further, the developing section 30K includes a black (K) liquid developer, and has the function of developing a latent image with the liquid developer to form a black monochromatic image.

The developing sections 30Y, 30C, 30M and 30K have the same structure. Therefore, in the following, the developing section 30Y will be representatively described.

As shown in FIG. 2, the developing section 30Y includes a photoreceptor 10Y which carries a latent image and rotates in the direction of the arrow shown in the drawings. The image forming apparatus 1000 further includes an electrifying roller 11Y, an exposure unit 12Y, a developing unit 100Y, a photoreceptor squeeze device 101Y, a primary transfer backup roller 51Y, an electricity removal unit 16Y, a photoreceptor cleaning blade 17Y, and a developer collecting section 18Y, and they are arranged in the named order along the rotational direction of the photoreceptor 10Y.

The photoreceptor 10Y includes a cylindrical conductive base member and a photosensitive layer (both not shown in the drawings) which is constituted of a material such as amorphous silicon or the like formed on the outer peripheral surface of the base member, and is rotatable about the axis thereof in the clockwise direction as shown by the arrow in FIG. 2.

The liquid developer is supplied onto the surface of the photoreceptor 10Y from the developing unit 100Y so that a layer of the liquid developer is formed on the surface thereof.

The electrifying roller 11Y is a device for uniformly electrifying the surface of the photoreceptor 10Y. The exposure unit 12Y is a device that forms an electrostatic latent image on the photoreceptor 10Y uniformly by means of laser beam irradiation.

The exposure unit 12Y includes a semiconductor laser, a polygon mirror, an F-θ lens, or the like, and irradiates a modulated laser beam onto the electrified photoreceptor 10Y in accordance with image signals received from a host computer such as a personal computer, a word processor or the like not shown in the drawings.

The developing unit 100Y is a device which develops the latent image to be visible with the liquid developer of the present invention. The details of the developing unit 100Y will be described later.

The photoreceptor squeeze device 101Y is disposed so as to face the photoreceptor 10Y at the downstream side of the developing unit 100Y in the rotational direction thereof. The photoreceptor squeeze device 101Y is composed from a photoreceptor squeeze roller 13Y, a cleaning blade 14Y which is press contact with the photoreceptor squeeze roller 13Y for removing a liquid developer adhering to the surface of the photoreceptor squeeze roller 13Y, and a developer collecting section 15Y for collecting the removed liquid developer.

The photoreceptor squeeze device 101Y has a function of collecting an excess carrier (insulation liquid) and a fog toner which is inherently unnecessary from the liquid developer developed by the photoreceptor 10Y thereby increasing a ratio of the toner particles in the image to be formed.

The primary transfer backup roller 51Y is a device for transferring a monochrome toner image formed on the photoreceptor 10Y to the intermediate transfer section (belt) 40.

The electricity removal unit 16Y is a device for removing a remnant charge on the photoreceptor 10Y after an intermediate image has been transferred to the intermediate transfer section 40 by the primary transfer backup roller 51Y.

The photoreceptor cleaning blade 17Y is a member made of rubber and provided in contact with the surface of the photoreceptor 10Y, and has a function of scrapping off the liquid developer remaining on the photoreceptor 10Y after the image has been transferred onto the intermediate transfer section 40 by the primary transfer backup roller 51Y.

The developer collecting section 18Y is provided for collecting the liquid developer removed by the photoreceptor cleaning blade 17Y.

The intermediate transfer section 40 is composed from an endless elastic belt which is wound around a belt drive roller 41 to which driving force is transmitted by a motor not shown in the drawings, a pair of driven rollers 42 and 43, and a tension roller 44. The intermediate transfer section 40 is rotationally driven in the anticlockwise direction by the belt drive roller 41 while being in contact with the photoreceptors 10Y, 10M, 10C and 10K at each of positions that the primary transfer backup rollers 51Y, 51C, 51M and 51K are in contact with an intermediate transfer belt (feed belt).

The intermediate transfer section 40 is constructed so that a predetermined tension is given by the tension roller 44 to prevent loosening of the endless elastic belt. The tension roller 44 is disposed at the downstream side of the intermediate transfer section 40 in the moving direction thereof with respect to one driven roller 42 and at the upstream side of the intermediate transfer section 40 in the moving direction thereof with respect to the other driven roller 43.

Monochromatic images corresponding to the respective colors formed by the developing sections 30Y, 30C, 30M and 30K are sequentially transferred by the primary transfer backup rollers 51Y, 51C, 51M and 51K so that the monochromatic images corresponding to the respective colors are overlaid, thereby enabling a full color toner image (intermediate transferred image) to be formed on the intermediate transfer section 40 which will be described later.

The intermediate transfer section 40 carries the monochromatic images formed on the respective photoreceptors 10Y, 10M, 10C and 10K in a state that these images are successively secondary-transferred onto the belt so as to be overlaid one after another, and the overlaid images are transferred onto a recoding medium F5 such as paper, film and cloth as a single color image in the secondary transfer unit 60 described later.

In the meantime, when the toner image is transferred onto the recording medium F5 in the secondary transfer process, there is a case that the recording medium F5 is not a flat sheet material due to fibers thereof. The elastic belt is employed as a means for increasing a secondary transfer characteristic for such a non-flat sheet material.

Further, the intermediate transfer section 40 is also provided with a cleaning device which is composed form an intermediate transfer section cleaning blade 46, a developer collecting section 47 and a non-contact type bias applying member 48. The intermediate transfer section cleaning blade 46 and the developer collecting section 47 are arranged on the side of the driven roller 43.

The intermediate transfer section cleaning blade 46 has a function of scrapping off of the liquid developer adhering to the intermediate transfer section 40 to remove it after the image has been transferred onto a recording medium F5 by the secondary transfer unit (secondary transfer section) 60.

The developer collecting section 47 is provided for collecting the liquid developer removed by the intermediate transfer section cleaning blade 46.

The non-contact type bias applying member 48 is disposed so as to be apart from the intermediate transfer section 40 at an opposite position of the tension roller 44 through the intermediate transfer section (that is, elastic belt) 40.

The non-contact type bias applying member 48 applies a bias voltage having a reversed polarity with respect to a polarity of the toner particles to each of the toner particles (solid content) contained in the liquid developer remaining on the intermediate transfer section 40 after the image has been secondary-transferred onto the recording medium 5F. This makes it possible to remove electricity from the remaining toner particles so that it is possible to lower electrostatic adhesion force of the toner particles to the intermediate transfer section 40. In this embodiment, a corona electrification device is used as the non-contact type bias applying member 48.

In this regard, it is to be noted that the non-contact type bias applying member 48 may not be necessarily disposed at the opposite position of the tension roller 44 through the intermediate transfer section (that is, elastic belt) 40.

For example, the non-contact type bias applying member 48 may be disposed at any position between the downstream side of the intermediate transfer section 40 in the moving direction thereof with respect to one driven roller 42 and the upstream side of the intermediate transfer section 40 in the moving direction thereof with respect to the other driven roller 43 such as any position between the driven roller 42 and the tension roller 44.

Note that as the non-contact type bias applying member 48, various known non-contact type electrification devices other than the corona electrification device may be employed.

An intermediate transfer second squeeze device 52Y is provided at the downstream side of the primary transfer backup roller 51Y in the moving direction of the intermediate transfer section 40 (see FIG. 2).

The intermediate transfer squeeze device 52Y is provided as a means for removing an excess amount of the insulation liquid from the transferred liquid developer in the case where the liquid developer transferred onto the intermediate transfer section 40 does not have a desired dispersion state.

As shown in FIG. 2, the intermediate transfer squeeze device 52Y includes an intermediate transfer squeeze roller 53Y, an intermediate transfer squeeze roller cleaning blade 55Y which is in press contact with the intermediate transfer squeeze roller 53Y for cleaning the surface thereof, and a liquid developer collecting section 56Y which collects the liquid developer removed from the intermediate transfer squeeze roller 53Y by the intermediate transfer squeeze roller cleaning blade 55Y.

The intermediate transfer squeeze device 52Y has a function of collecting an excess carrier from the liquid developer primary-transferred to the intermediate transfer section 40 to increase a ratio of the toner particles in an image to be formed and collecting a fog toner which is inherently unnecessary.

The secondary transfer unit 60 is provided with a pair of secondary transfer rollers 61 and 62 which are arranged so as to depart from each other for a predetermined distance along the moving direction of the recording medium F5. Among the pair of the secondary transfer rollers 61 and 62, the upstream side secondary transfer roller 61 is arranged upstream side of the intermediate transfer section 40 in the rotational direction thereof. This upstream side secondary transfer roller 61 is capable of being in press contact with the belt drive roller 41 through the intermediate transfer section 40.

Among the pair of the secondary transfer rollers 61 and 62, the downstream side secondary transfer roller 62 is arranged at the downstream side of a recording medium F5 in the moving direction thereof. This downstream side secondary transfer roller 62 is capable of being in press contact to the recording medium F5 with the driven roller 42 through the intermediate transfer section 40.

Namely, intermediate transfer images which are formed on the intermediate transfer section 40 by overlaying the transferred monochromatic color images in a state that the recording medium F5 is in contact with the intermediate transfer section 40 which wound around the belt drive roller 41 and the driven roller 42 and goes through between the driven roller 42 and the downstream side secondary transfer roller 62 and between the belt driven roller 41 and the upstream side secondary transfer roller 61 are secondary-transferred on the recording medium F5.

In this case, the belt driven roller 41 and the driven roller 42 have functions as the upstream side secondary transfer roller 61 and the downstream side secondary transfer roller 62, respectively.

Namely, the belt driven roller 41 is also used as an upstream side backup roller arranged at the upstream side of the recording medium F5 to the driven roller 42 in the moving direction thereof in the secondary transfer unit 60.

The driven roller 42 is also used as a downstream side backup roller arranged in the downstream side of the recording medium F5 to the belt driven roller 41 in the moving direction thereof in the secondary transfer unit 60.

The recording medium F5 which have been conveyed to the secondary transfer unit 60 is allowed to adhere to the intermediate transfer belt at positions between the upstream side secondary transfer roller 61 and the belt driven roller 41 (nip starting position) and between the downstream side secondary transfer roller 62 and the driven roller 42 (nip ending position).

Since this makes it possible to secondary-transfer the intermediate transfer images of a full color on the intermediate transfer section 40 to the recording medium F5 with adhesion to the intermediate transfer section 40 for a predetermined period of time, it is possible to secondary-transfer the intermediate images reliably.

The secondary transfer unit 60 is provided with a secondary transfer roller cleaning blade 63 and a developer collecting section 64 with respect to the secondary transfer roller 61. The secondary transfer unit 60 is also provided with a secondary transfer roller cleaning blade 65 and a developer collecting section 66 with respect to the secondary transfer roller 62.

Each of the secondary transfer roller cleaning blades 63 and 65 is in contact with the respective secondary transfer rollers 61 and 62 to clean them. Namely, after the completion of the secondary-transfer, the liquid developer remaining on the surfaces of each of the secondary transfer rollers 61 and 62 is scrapped off by the secondary transfer roller cleaning blades 63 and 65 and removed from the secondary transfer rollers 61 and 62.

The liquid developer scrapped off from the surfaces of each of the respective secondary transfer rollers 61 and 62 by each of the secondary transfer roller cleaning blades 63 and 65 is collected and preserved by each of the developer collecting sections 64 and 66.

A toner image (transferred image) F5*a* transferred onto the recording medium F5 by the secondary transfer section 60 is fed to a fixing unit (fixing device) F40 (which will be described later), where the unfixed toner image is fixed onto the recoding medium F5.

Hereinbelow, a detailed description will be made with regard to the developing units 100Y, 100C, 100M and 100K. In this regard, it is to be noted that since the developing units 100Y, 100C, 100M and 100K have the same structure, in the following description the developing section 100Y will be representatively described.

As shown in FIG. 2, the developing unit 100Y includes a liquid developer storage section 31Y, an application roller 32Y, a regulating blade 33Y, a liquid developer stirring roller 34Y, a developing roller 20Y, a developing roller cleaning blade 21Y and a corona electrification device (pressing means) 23Y.

The liquid developer storage section 31Y is provided for storing a liquid developer for developing a latent image formed on the photoreceptor 10Y. The application roller 32Y has the function of supplying the liquid developer to the developing roller 20Y.

As shown in FIG. 2, the application roller 32Y is of the type so-called as "Anilox Roller" which is constructed from a metallic roll made of iron or the like of which surface has grooves formed regularly and helically, and a nickel plating formed on the surface thereof.

The diameter of the roller is about 25 mm. As described above embodiment, in this embodiment, a number of grooves 32Y are formed inclinedly with respect to the rotational direction D2 by means of a cutting process or rolling process.

The application roller 32Y rotates in an anti-clockwise direction and makes contact with the liquid developer so that the liquid developer stored in the liquid developer storage section 31Y is carried by the grooves, and the carried liquid developer is then conveyed to the developing roller 20Y.

The regulating blade 33Y is provided in contact with the surface of the application roller 32Y for regulating an amount of the liquid developer carried on the application roller 32Y. Specifically, the regulating blade 33Y scrapes away an excess amount of the liquid developer on the application roller 32Y so that an amount of the liquid developer to be supplied onto the developing roller 20Y by the application roller 32Y can be regulated.

The regulating blade 33Y is formed from an elastic body made of an urethane rubber, and supported by a regulating blade supporting member made of a metal such as iron or the like. Further, the regulating blade 33Y is arranged on the side where the application roller 32Y comes out of the liquid developer with its rotation (that is, on the left side in FIG. 2).

In this regard, it is to be noted that the rubber hardness of the regulating blade 33Y, that is, a rubber hardness (77) of a portion of the regulating blade 33Y which is in press contact with the surface of the application roller 32Y is about 77 according to JIS-A.

The rubber hardness (77) of the regulating blade 33Y is lower than the rubber hardness of an elastic layer of the developing roller 20Y (described later) which is a rubber hardness (about 85) of a portion of the developing roller 20Y which is in press contact with the surface of the application roller 32Y.

Further, an excess amount of the liquid developer scraped off by the regulating blade 33Y is collected in the liquid developer storage section 31Y and it is then reused.

The liquid developer stirring roller 34Y has a function of stirring the liquid developer so as to be homogeneously dispersed. By providing such a liquid developer stirring roller 34Y, even when a plurality of toner particles 1 are aggregated in the liquid developer storage section 31Y, it is possible to disperse the plurality of toner particles 1 reliably. In particular, since the liquid developer of the present invention has superior dispersibility of the toner particles in the insulation liquid, it is possible to disperse the plurality of toner particles 1 more effectively. Further, even when the liquid developer used once is reused, it is possible to disperse the plurality of toner particles 1 in an insulation liquid easily.

In the liquid developer storage section 31Y, the plurality of toner particles 1 of the liquid developer are positively charged. The liquid developer is stirred by the liquid developer stirring roller 34Y to be a homogeneously dispersed state, and such a liquid developer is dipped from the liquid developer storage section 31Y according to the rotation of the application roller 32Y so that the liquid developer is supplied onto the developing roller 20Y with the amount of the liquid developer being regulated by the regulating blade 33Y.

The developing roller 20Y is provided for conveying the liquid developer to a developing position opposed to the photoreceptor 10Y in order to develop a latent image carried on the photoreceptor 10Y with the liquid developer.

The liquid developer from the application roller 32Y is supplied onto the surface of the developing roller 20Y so that a layer of the liquid developer 201Y is formed on the surface.

The developing roller 20Y includes an inner core member made of a metal such as iron or the like and an elastic layer having conductivity and provided onto an outer periphery of the inner core member. The diameter of the developing roller 20Y is about 20 mm.

The elastic layer has a two layered structure which includes an inner layer made of urethane rubber and an outer layer (surface layer) made of urethane rubber. The inner layer has a rubber hardness of 30 according to JIS-A and a thickness of about 5 mm, and the outer layer has a rubber hardness of about 85 according to JIS-A and a thickness of about 30 μm.

The developing roller 20Y is in press contact with both the application roller 32Y and the photoreceptor 10Y in a state that the outer layer of the developing roller 20Y is elastically deformed.

The developing roller 20Y is rotatable about its central axis, and the central axis is positioned below the central axis of the photoreceptor 10Y. Further, the developing roller 20Y rotates in a direction (clockwise direction in FIG. 2) opposite to the rotational direction (anti-clockwise direction in FIG. 2) of the photoreceptor 10Y.

It is to be noted that an electrical field is generated between the developing roller 20Y and the photoreceptor 10Y when a latent image formed on the photoreceptor 10Y is developed.

The corona electrification device (pressing means) 23Y is a device having a function of pressing the toner particles of the liquid developer carried by the developing roller 20Y. In other words, the corona electrification device 23Y is a device that applies an electrical field of the same polarity as the toner particles 1 to the liquid developer layer 201Y described above to thereby evenly distribute the toner particles at the vicinity of the developing roller 20Y in the liquid developer layer 201Y as shown in FIG. 3.

By evenly distributing the toner particles in this way, it is possible to improve an image density (developing efficiency), and as a result it becomes possible to obtain a high quality clear image. In particular, the liquid developer of the present invention has superior charge property (positive charge property) of the toner particles. Therefore, even if an electric field applied to the toner particles from the corona electrification device 23Y is relatively weak, it is possible to allow the toner particles to be sufficiently charged positively and thereby to make the toner particles be in the state of being pressed. This makes it possible to make a voltage applied to the corona electrification device 23Y relatively low, which results in saving electric power.

In this regard, it is to be noted that the application roller 32Y is driven by a power source (not shown) which is difference from a power source for driving the developing roller 20Y. Therefore, by changing a rotational speed (linear velocity) ratio of each of the application roller 32Y and the developing roller 20Y, it is possible to adjust an amount of the liquid developer to be supplied onto the developing roller 20Y.

The developing unit 100Y has a developing roller cleaning blade 21Y made of rubber and provided in contact with the surface of the developing roller 20Y and a developer collecting section 22Y. The developing roller cleaning blade 21Y is a device for scrapping off the liquid developer remaining on the developing roller 20Y after the development of an image has been carried out at the developing position. The liquid developer removed by the developing roller cleaning blade 21Y is collected in the developer collecting section 22Y.

As shown in FIG. 1 and FIG. 2, the image forming apparatus 1000 is provided with liquid developer supply sections 80Y, 80M, 80C and 80K which supply the liquid developers to the developing sections 30Y, 30M, 30C and 30K, respectively.

The liquid developer supply sections 80Y, 80M, 80C and 80K have the same structure, respectively. Namely, the liquid developer supply sections 80Y, 80M, 80C and 80K are provided with liquid developer tanks 81Y, 81M, 81C and 81K, insulation liquid tanks 82Y, 82M, 82C and 82K and stirring devices 83Y, 83M, 83C and 83K, respectively.

In each of the liquid developer tanks 81Y, 81M, 81C and 81Y, a liquid developer of high concentration which corresponds to each of the different colors is stored. Further, in each of the insulation liquid tanks 82Y, 82M, 82C and 82K, the insulation liquid is stored.

Further, each of the stirring devices 83Y, 83M, 83C and 83K is constructed so that a predetermined amount of the high concentration liquid developer is supplied from each of the corresponding liquid developer tanks 81Y, 81M, 81C and 81Y and a predetermined amount of the insulation liquid is supplied from each of the corresponding insulation liquid tanks 82Y, 82M, 82C and 82K.

In each of the stirring devices 83Y, 83M, 83C and 83K, the supplied high concentration liquid developer and the supplied insulation liquid are mixed with being stirred to prepare the liquid developers corresponding to different colors which are to be used in the developing sections 31Y, 31M, 31C and 31K, respectively. The liquid developers prepared in the respective stirring devices 83Y, 83M, 83C and 83K in this way are supplied to the corresponding liquid developer storage sections 31Y, 31M, 31C and 31K, respectively.

As shown in FIG. 1 and FIG. 2, the liquid developers collected in the respective developer collecting sections 15Y, 15M, 15C and 15K and the liquid developers collected in the respective developer collecting sections 22Y, 22M, 22C and 22K are respectively collected to the stirring devices 83Y, 83M, 83C and 83K and then they are reused. In particular, in the liquid developer of the present invention, the dispersant described above firmly adheres to the surfaces of the toner particles as described above. Therefore, the liquid developer of the present invention has superior dispersibility of the toner particles in the insulation liquid. As a result, the liquid developer used in once can be reused easily.

Next, a description will be made with regard to a fixing section F40.

The fixing unit (fixing section) F40 is provided for fixing unfixed toner images F5*a* formed on the developing section and the transfer section onto a recording medium F5. As shown in the FIG. 4, the fixing unit (fixing section) F40 is generally composed from a heat fixing roller F1, a pressure roller F2, a heat resistant belt F3, a belt tension member F4, a cleaning member F6, a frame F7 and a spring F9.

The heat fixing roller (hereinafter, simply referred to as "fixing roller") F1 has a roller base F1*b* formed from a pipe member, an elastic body F1*c* which covers the outer periphery of the roller base F1*b*, and a pair of halogen lamps F1*a* provided inside the roller base F1. Each of the halogen lamps F1*a* has a columnar shape and acts as a heat source. The heat fixing roller F1 having the above structure is rotatable in an anti-clockwise direction shown by the arrow in the drawing.

Further, as described above, inside the heat fixing roller F1, two halogen lamps F1*a*, F1*a* each having a columnar shape and acting as a heat source are provided. These halogen lamps F1*a*, F1*a* are provided with heating elements, respectively, which are arranged at different positions.

With this arrangement, by selectively lighting up any one or both of the halogen lamps F1*a*, F1*a*, it is possible to easily carry out a temperature control under different conditions such as a case where a wide recording medium is used or a narrow recording medium is used, and/or a case where a fixing nip part at which the heat resistant belt F3 is wound around the heat fixing roller F1 is to be heated or a part at which the belt tension member F4 is in slidably contact with the heat fixing roller F1 is to be heated.

The pressure roller F2 is arranged so as to face the heat fixing roller F1 so that a pressing pressure is applied against the recording medium F5 on which an unfixed toner image F5*a* is formed through a heat resistant belt F3.

Further, as described above, the pressure roller F2 has a roller base F2*b* formed from a pipe member and an elastic body F2*c* which covers the outer periphery of the roller base F2*b*. The pressure roller F2 is rotatable in a clockwise direction shown by the arrow in the drawing.

On the outer surface of the elastic body F1*c* of the heat fixing roller F1, there is formed a PFA layer. By composing the heat fixing roller F1 and the pressure roller F2 as mentioned above, even if the thickness of the elastic body F1*c* of the heat fixing roller F1 is different from the thickness of the elastic body F2*c* of the pressure roller F2, the elastic body F1*c* and the elastic body F2*c* are subjected to substantially uniform elastic deformation to form a so-called horizontal nip.

Further, since there is no difference between a circumferential velocity of the heat fixing roller F1 and a conveying speed of a heat resistant belt F3 described below or a recording medium F5, it is possible to fix an image in an extremely stable manner.

The heat resistant belt F3 is a ring-shaped endless belt, and it is would around the outer circumferences of the pressure roller F2 and the belt tension member F4 so that it can be moved with being held between the heat fixing roller F1 and the pressure roller F2 in a pressed state.

The heat resistant belt F3 is formed from a seamless tube having a thickness of 0.03 mm or more. Further, the seamless tube has a two layered structure in which its surface (which is the surface thereof that makes contact with the recording medium F5) is formed of PFA, and the opposite surface thereof (that is, the surface thereof that makes contact with the pressure roller F2 and the belt tension member F4) is formed of polyimide.

However, the structure of the heat resistant belt F3 is not limited to the structure described above, and it may be formed from other materials. Examples of tubes formed from other materials include a metallic tube such as a stainless tube or a nickel electrocasting tube, a heat-resistance resin tube such as a silicone tube, and the like.

The belt tension member F4 is disposed on the upstream side of the fixing nip part between the heat fixing roller F1 and the pressure roller F2 in the recording medium F5 conveying direction. Further, the belt tension member F4 is pivotally disposed about the rotation shaft F2*a* of the pressure roller F2 so as to be movable along the arrow P.

The belt tension member F4 is constructed so that the heat resistant belt F3 is extended with tension in the tangential direction of the heat fixing roller F1 in a state that the recording medium F5 does not pass through the fixing nip part. When the fixing pressure is large at an initial position where the recording medium F5 enters the fixing nip part, there is a case that the recording medium F5 can not enter the fixing nip part smoothly and thereby fixation is performed in a state that a tip part of the recording medium F5 is folded.

However, in this embodiment, the belt tension member F4 is provided so that the heat resistant belt F3 is extended with tension in the tangential direction of the heat fixing roller F1 as described above, there is formed an introducing portion for smoothly introducing the recording medium F5, so that the recording medium F5 can be introduced into the fixing nip part in a stable manner.

The belt tension member F4 is a roughly semi-circular member for slidably guiding the heat resistant belt F3 (that is, the heat resistant belt F3 slidably moves on the belt tension member F4). The belt tension member F4 is fitted into the inside of the heat resistant belt F3 so as to impart tension f to the heat resistant belt F3 in cooperation with the pressure roller F2.

The belt tension member F4 is arranged at a position where a nip part is formed by pressing a part of the heat resistant belt F3 toward the heat fixing roller F1 over the tangential line L on the pressing portion at which the heat fixing roller F1 is pressed against the pressure roller F2.

The protruding wall F4*a* is formed on any one or both of the end surfaces of the belt tension member F4 which are located in the axial direction thereof. The protruding wall F4*a* is provided for restricting the heat resistant belt F3 from being off to the side by abutment thereto in a case that the heat resistant belt F3 is deviated in any one of the sides.

Further, a spring F9 is provided between the frame and an end portion of the protruding wall F4*a* which is located at an opposite side from the heat fixing roller F1 so as to slightly press the protruding wall F4*a* of the belt tension member F4 against the heat fixing roller F1. In this way, the belt tension member F4 is positioned with respect to the heat fixing roller F1 in slidably contact with the heat fixing roller F1.

A position where the belt tension member F4 is slightly pressed against the heat fixing roller F1 is set as a nip starting position and a position where the pressure roller F2 is pressed against the heat fixing roller F1 is set as a nip ending position.

In the fixing unit F40, a recording medium F5 on which an unfixed toner image F5*a* is formed using the above liquid developing unit enters into the fixing nip part from the nip starting position, then passes between the heat resistant belt F3 and the heat fixing roller F1, and then exits from the nip ending position, and in this way an unfixed toner image F5*a* formed on the recording medium F5 is fixed.

Thereafter, the recording medium F5 on which the toner image is formed is fed out toward the tangential direction L of the pressing portion of the press roller F2 against the heat fixing roller F1.

The cleaning member F6 is disposed between the pressure roller F2 and the belt tension member F4. The cleaning member F6 is provided for cleaning foreign substances or wear debris on the inner surface of the heat resistant belt F3 by slidably contacting with the inner surface of the heat resistant belt F3.

By cleaning the foreign substances and wear debris in this way, it is possible to refresh the heat resistant belt F3 to eliminate the unstable factors on the frictional coefficients described above. Further, the belt tension member F4 is formed with a concave portion F4*f*, and this concave portion F4*f* is preferably used for collecting the foreign substances or wear debris eliminated from the heat resistant belt F3.

Further, the fixing unit F40 is provided with a removal blade (removal means) F12 for removing an insulation liquid adhering to or remaining on the surface of the heat fixing roller F1 after the toner image F5*a* has been fixed onto the recording medium F5. The insulation liquid removal blade F12 can not only remove the insulation liquid but also remove a toner or the like which has been transferred onto the heat fixing roller F1 at the same time upon fixation.

In order to stably drive the heat resistant belt F3 by the pressure roller F2 in a state that the heat resistant belt F3 is wound around the pressure roller F2 and the belt tension member F4, the frictional coefficient between the pressure roll F2 and the heat resistant belt F3 is set to be larger than the frictional coefficient between the belt tension member F4 and the heat resistant belt F3.

However, there is a case that these frictional coefficients become unstable due to entering of foreign substances between the heat resistant belt F3 and the pressure roller F2 or between the heat resistant belt F3 and the belt tension member F4, or due to the abrasion of the contacting part between the heat resistant belt F3 and the pressure roller F2 or the belt tension member F4.

Accordingly, the winding angle of the heat resistant belt F3 with respect to the belt tension member F4 is set to be smaller than the winding angle of the heat resistant belt F3 with respect to the pressure roller F2, and the diameter of the belt tension member F4 is set to be smaller than the diameter of the pressure roller F2.

With this structure, the distance that the heat resistant belt F3 moves on the belt tension member F4 becomes short so that unstable factors due to deterioration with the elapse of time and disturbance can be avoided or reduced. As a result, it is possible to drive the heat resistant belt F3 with the pressure roller F2 in a stable manner.

A fixing temperature which is applied to the toner images by the heat fixing roller F1 is preferably in a range of 80 to 160° C., more preferably in a range of 100 to 150° C., and even more preferably in a range of 100 to 140° C.

In the foregoing, the present invention was described based on the preferred embodiments, but the present invention is not limited to these embodiments.

For example, the liquid developer of the present invention is not limited to one that is to be used in the image forming apparatuses as described above.

Further, the liquid developer of the present invention is not limited to one produced by the method described above.

Further, in the above described embodiment, an electrolyte is added to the water-based emulsion obtained by adding the resin solution to the aqueous solution so that the particles of the dispersoid are associated to thereby form associated particles. But the present invention is not limited thereto.

For example, a coloring agent, a monomer of a resin material containing the rosin resin described above, a dispersant described above, a interfacial active agent and a polymerization initiator are dispersed in the water-based liquid, and a water-based emulsion is prepared by an emulsion polymerization, and then an electrolyte is added to the water-based emulsion, so that the particles of the dispersoid are associated to thereby form associated particles (this method is called as "emulsion polymerization association method"). Further, the obtained water-based emulsion is dried by a spry to thereby obtain associated particles.

Further, it is to be noted that the image forming apparatus 1000 includes the corona electrification device 23Y in the embodiment described above, but the image forming apparatus 1000 may not include the corona electrification device 23Y.

EXAMPLES

1 Production of Liquid Developer

Liquid developers were produced as follows.

Example 1

First, toner particles were produced. In this regard, it is to be noted that in this specification steps of the liquid developer in which a temperature is not mentioned were carried out at room temperature (25° C.).

Step of Preparing Dispersion Liquid

Preparation of Coloring Agent Master Batch

First, 60 parts by weight of polyester resin (acid value thereof was 10 mgKOH/g, glass transition point (Tg) thereof was 55° C., and softening point thereof was 107° C.) and 60 parts by weight of cyan type pigment ("Pigment Blue 15:3" produced by Dainichiseika Color & Chemicals Mfg. Co., Ltd.) as a coloring agent were prepared. These components were mixed at a mass ratio of 50:50 using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled. The kneaded material that had been cooled as described above was coarsely ground using a hammer mill to be formed into powder constituting a coloring agent master batch which had an average particle size of 1.0 mm or less. In this way, the coloring agent master batch was obtained.

Preparation of Resin Solution

Next, 175 parts by weight of methylethylketone, 172.3 parts by weight of the polyester resin described above, and 55.3 parts by weight of rosin modified phenol resin ("TAMANOL135" produced by ARAKAWA CHEMICAL INDUSTRIES, LTD., acid value thereof was 18 mgKOH/g, softening point thereof was in a range of 130 to 140° C., and weight-average molecular weight was 15,000) were added into a flask in which 97.5 parts by weight of the coloring agent master batch was contained to obtain a mixture and then the mixture was stirred with a high speed disperser ("T.K. ROBOMIX/T.K. HOMO DISPER MODEL 2.5" produced by PRIMIX Corporation, which are the registered trademarks). And then, 1.38 parts by weight of NEOGEN SC-F (an emulsifying agent produced by DAI-ICHI KOGYO SEIYAKU Co., LTD.) was added into the mixture to obtain a resin solution. In the resin solution, the pigment was finely dispersed homogeneously.

Formation of Dispersoid

Next, 72.8 parts by weight of 1N ammonia water was added to the resin solution in the flask to obtain a mixture. Then, the mixture was sufficiently stirred by a high speed disperser ("T.K. ROBOMIX/T.K. HOMO DISPER MODEL 2.5" produced by PRIMIX Corporation, which are the registered trademarks) under the conditions that a rotational velocity of a tip of a stirring blade thereof was 7.5 m/s. Thereafter, 400 parts by weight of deionized water was added into the mixture in the flask drop by drop under the conditions that the temperature of the mixture in the flask was adjusted at 25° C. and the mixture was stirred at 14.7 m/s of the rotational velocity of the tip of the stirring blade to thereby cause phase inversion emulsification. Thereafter, 100 parts by weight of deionized water was added into the mixture in the flask while stirring the mixture. In this way, a water-based dispersion liquid in which a dispersoid composed of the resin material (the polyester resin and the rosin resin) was dispersed was obtained.

Associated Particle Formation Step

Next, the water-based dispersion liquid was put into a stirring flask having a maxblend stirring blade. Then, the water-based dispersion liquid was continued to be stirred under the conditions that the temperature of the water-based dispersion liquid in the stirring flask was adjusted at 25° C. and the water-based dispersion liquid was stirred at 14.7 m/s of the rotational velocity of the tip of the stirring blade.

Thereafter, 200 parts by weight of 5.0% natrium sulfate solution was added into the water-based dispersion liquid drop by drop under the same conditions as described above to produce associated particles by associating fine particles of the dispersoid in the water-based dispersion liquid. After the addition of the natrium sulfate solution to the water-based dispersion liquid was ended, the water-based dispersion liquid was still continued to be stirred until the average particle size (the volume median diameter Dv (50)) of the associated particles became 2.5 μm to obtain an associated particle dispersion liquid. Thereafter, 200 parts by weight of deionized water was added into the associated particle dispersion liquid. In this way, the production process of the associated particles was completed.

Step of Removing Solvent in Associated Particle Dispersion Liquid

The associated particle dispersion liquid was dried under reduced pressure to remove the organic solvent (methylethylketone) so that an amount of a solid content in the associated particle dispersion liquid became 30 wt % and to thereby obtain a slurry containing the associated particles of the dispersoid.

Step of Washing

Next, by repeatedly carrying out the process that the slurry was separated into a solid content and a liquid content and then the solid content separated from the slurry was dispersed into deionized water to thereby obtain a slurry, the associated particles were washed. Thereafter, by using a suction filtration method, a wet cake containing the resin material (the polyester resin and the rosin resin) and the coloring agent was obtained. In this regard, an amount of moisture content in the wet cake was 35 wt %.

Step of Drying

Next, the wet cake was dried by using a vacuum drier to thereby obtain toner particles.

Dispersion Step 37.5 parts by weight of the thus obtained toner particles, 1.88 parts by weight of Disperbyk-116 as a dispersant (produced by BYK Japan KK, amine value thereof was 65 mgKOH/g), 150 parts by weight of rape oil as an insulation liquid ("high-oleic rape oil" produced by The Nisshin OilliO Group, Ltd.), and 0.5 parts by weight of aluminium stearate as a charge control agent (produced by NOF CORPORATION) were put in a ceramics pot (the size of the ceramic pot was 600 ml), and then zirconia balls each having a diameter of 1 mm were added in the ceramics pot so that a volume filling factor thereof became 85%.

They were then mixed by a desk pot mill at a rotational speed of 220 rpm for 24 hours, to thereby obtain a liquid developer in which the toner particles were dispersed in the insulation liquid.

The average particle size (the volume median diameter Dv (50)) of the thus obtained toner particles was 1.85 μm. In this regard, it is to be noted that an average particle size of the associated particles and an average particle size of the toner particles obtained in each of the Examples 1 to 11 and the Comparative Examples 1 and 2 were measured in the volume basis with a particle analysis apparatus ("Mastersizer 2000" produced by Malvern Instruments Ltd.).

Further, a viscosity of the liquid developer at a temperature of 25° C. was 55 mPa·s.

Furthermore, a magenta liquid developer, a yellow liquid developer, and a black liquid developer which were the same as those described above were produced excepting that Pigment Red 238 (produced by Sanyo Color Works) as a magenta pigment, Pigment Yellow 180 (Clariant K.K.) as a yellow pigment, and a carbon black ("Printex L", produced by Degussa AG) as a black pigment were respectively used instead of the cyanine pigment.

Example 2

In Example 2, liquid developers of different colors were produced in the same manner as in the Example 1 except that a kind of used rosin resin was changed to rosin modified maleic acid resin ("MALKYD No. 1" produced by ARAKAWA CHEMICAL INDUSTRIES, LTD., acid value thereof was 25 mgKOH/g, softening point thereof was in a range of 120 to 130° C., and weight-average molecular weight was 3,100).

Example 3

In Example 3, liquid developers of different colors were produced in the same manner as in the Example 1 except that a kind of used rosin resin was changed to rosin modified phenol resin ("KG221" produced by ARAKAWA CHEMICAL INDUSTRIES, LTD., acid value thereof was 22 mgKOH/g, softening point thereof was in a range of 172 to 182° C., and weight-average molecular weight was 100,000).

Example 4

In Example 4, liquid developers of different colors were produced in the same manner as in the Example 1 except that a kind of used rosin resin was changed to rosin modified phenol resin ("TAMANOL145" produced by ARAKAWA CHEMICAL INDUSTRIES, LTD., acid value thereof was 18 mgKOH/g, softening point thereof was in a range of 140 to 155° C., and weight-average molecular weight was 20,000).

Example 5

In Example 5, liquid developers of different colors were produced in the same manner as in the Example 1 except that a kind of used dispersant was changed to EFKA-4080 (produced by Chiba Specialty Chemical Co., amine value thereof was 4 mgKOH/g).

Example 6

In Example 6, liquid developers of different colors were produced in the same manner as in the Example 1 except that a kind of used dispersant was changed to Agrisperse 712 (produced by New Century Coat Co., amine value thereof was 100 mgKOH/g).

Example 7

In Example 7, liquid developers of different colors were produced in the same manner as in the Example 1 except that a kind of used polyester resin was changed to styrene-acrylate ester copolymer (acid value thereof was 6 mgKOH/g, glass transition point (Tg) thereof was 61.6° C., and softening point thereof was 116° C.), which was obtained by copolymerization of 4 parts by weight of styrene and 1 part by weight of butyl acrylate.

Examples 8 and 9

In each of Examples 8 and 9, liquid developers of different colors were produced in the same manner as in the Example 1 except that the ratios of the polyester and the rosin resin in the resin material were changed to those shown in Table 1.

Examples 10 and 11

In each of Examples 10 and 11, liquid developers of different colors were produced in the same manner as in the Example 1 except that the amounts of the dispersant consisted of a material having a predetermined amine value were changed to those shown in Table 1.

Comparative Example 1

In Comparative Example 1, liquid developers of different colors were produced in the same manner as in the Example 1 except that the rosin resin was not used.

Comparative Example 2

In Comparative Example 2, liquid developers of different colors were produced in the same manner as in the Example 1 except that the dispersant was not used.

With respect to the liquid developers of the Examples 1 to 11 and the Comparative Examples 1 and 2, the composition and the physical properties of each of the liquid developers, the physical properties of each of the dispersants in the liquid developers, and the amount of the dispersant with respect to the toner particles of 100 parts by weight in each of the liquid developers are shown in Table 1.

Further, in Table 1, it is also to be noted that polyester resin is shown as "PES", styrene-acrylate ester copolymer is shown as "ST-AC", rosin modified phenol resin is shown as "RP", rosin modified maleic acid resin is shown as "RM", Disperbyk-116 as a dispersant is shown as "D116", EFKA-4080 as a dispersant is shown as "E4080", and Agrisperse 712 as a dispersant is shown as "A712".

Table 1

TABLE 1

| | Liquid developer Toner particles Resin material | | | | | | | | |
|---|---|---|---|---|---|---|---|---|---|
| | Rosin resin | | | | | Component other than rosin resin | | | |
| | Kind | Acid values [mgKOH/g] | Softening point [° C.] | Weight-average molecular weight | Amount of rosin resin in resin material [wt %] | Kind | Acid values [mgKOH/g] | Softening point [° C.] | Amount of component other than resin rosin in resin material [wt %] |
| Ex. 1 | RP | 18 or less | 130-140 | 15000 | 20 | PES | 10 | 107 | 80 |
| Ex. 2 | RM | 25 or less | 120-130 | 3100 | 20 | PES | 10 | 107 | 80 |
| Ex. 3 | RP | 22 or less | 172-182 | 100000 | 20 | PES | 10 | 107 | 80 |
| Ex. 4 | RP | 18 or less | 140-155 | 20000 | 20 | PES | 10 | 107 | 80 |
| Ex. 5 | RP | 18 or less | 130-140 | 15000 | 20 | PES | 10 | 107 | 80 |
| Ex. 6 | RP | 18 or less | 130-140 | 15000 | 20 | PES | 10 | 107 | 80 |
| Ex. 7 | RP | 18 or less | 130-140 | 15000 | 20 | ST-AC | 6 | 116 | 80 |
| Ex. 8 | RP | 18 or less | 130-140 | 15000 | 40 | PES | 10 | 107 | 60 |
| Ex. 9 | RP | 18 or less | 130-140 | 15000 | 30 | PES | 10 | 107 | 70 |
| Ex. 10 | RP | 18 or less | 130-140 | 15000 | 20 | PES | 10 | 107 | 80 |
| Ex. 11 | RP | 18 or less | 130-140 | 15000 | 20 | PES | 10 | 107 | 80 |
| Comp. Ex. 1 | — | — | — | — | — | PES | 10 | 107 | 100 |
| Comp. Ex. 2 | RP | 18 or less | 130-140 | 15000 | 20 | PES | 10 | 107 | 80 |

| | Liquid developer | | | | |
|---|---|---|---|---|---|
| | Dispersant | | | | |
| | Kind | Amine values [mgKOH/g] | Amount of dispersant to toner particles of 100 parts by weight [parts by weight] | Kind of insulation liquid | Viscosity [mPa · S) |
| Ex. 1 | D116 | 65 | 5 | Rape oil | 55 |
| Ex. 2 | D116 | 65 | 5 | Rape oil | 58 |
| Ex. 3 | D116 | 65 | 5 | Rape oil | 62 |
| Ex. 4 | D116 | 65 | 5 | Rape oil | 63 |
| Ex. 5 | E4080 | 4 | 5 | Rape oil | 78 |
| Ex. 6 | A712 | 100 | 5 | Rape oil | 65 |
| Ex. 7 | D116 | 65 | 5 | Rape oil | 67 |
| Ex. 8 | D116 | 65 | 5 | Rape oil | 52 |
| Ex. 9 | D116 | 65 | 5 | Rape oil | 54 |
| Ex. 10 | D116 | 65 | 10 | Rape oil | 57 |
| Ex. 11 | D116 | 65 | 2 | Rape oil | 78 |
| Comp. Ex. 1 | D116 | 65 | 5 | Rape oil | 165 |
| Comp. Ex. 2 | — | — | — | Rape oil | 170 |

2 Evaluation

For the respective liquid developers produced as described above, the following evaluations were made.

2.1 Developing Efficiency

By using the image forming apparatus shown in FIG. 1 and in FIG. 2, a layer of a liquid developer was formed on the surface of the developing roller of the image apparatus using each of the liquid developers of different colors of the Examples 1 to 11 and the Comparative Examples 1 and 2, respectively.

Next, in the image forming apparatus in which the layer of the liquid developer was formed, the surface potential of the developing roller and the surface potential of the photoreceptor were respectively electrified at a voltage of 300V and a voltage of 500V uniformly. Thereafter, the photoreceptor was exposed so that the surface potential of the photoreceptor was decreased to a voltage of 50V to form a latent image on the photoreceptor.

Thereafter, the layer of the liquid developer formed on the surface of the developing roller was made to be passed between the developing roller and the photoreceptor so that a part of the toner particles of the liquid developer was transferred from the developing roller onto the photoreceptor to develop the latent image on the outer peripheral surface of the photoreceptor. Then, the toner particles remaining on the outer peripheral surface of the developing roller and the toner particles transferred on the outer peripheral surface of the photoreceptor were picked up by attaching adhesive tapes to the outer peripheral surface of the developing roller and the outer peripheral surface of the photoreceptor, respectively.

Thereafter, the adhesive tapes carrying the toner particles thereon were attached to recording papers so as to transfer the toner particles to each of the recording papers. And then, an amount of the toner particles attached to each of the adhesive tapes was measured using the recording papers. Based on the measurement values, a developing efficiency of each of the liquid developers was calculated and the calculated results were evaluated according to the following four criteria A to D. Here, the developing efficiency is defined by a value obtained by dividing the amount of the toner particles picked up from the photoreceptor by the sum of both the amount of the toner particles picked up from the photoreceptor and the amount of the toner particles picked up from the developing roller and further multiplying by 100.

A: Developing efficiency was 95% or higher, and the developing efficiency was very good.

B: Developing efficiency was 90% or higher but lower than 95%, and the developing efficiency was good.

C: Developing efficiency was 80% or higher but lower than 90%, and the developing efficiency was normal in practical use.

D: Developing efficiency was lower than 80%, and the developing efficiency was bad.

2.2 Transferring Efficiency

By using the image forming apparatus shown in FIG. 1 and in FIG. 2 a layer of a liquid developer was formed on the surface of the photoreceptor of the image apparatus using each of the liquid developers of different colors of the Examples 1 to 11 and the Comparative Examples 1 and 2, respectively.

Thereafter, the layer of the liquid developer formed on the outer peripheral surface of the photoreceptor was made to be passed between the photoreceptor and the intermediate transfer section so that the toner particles were transferred from the photoreceptor onto the intermediate transfer section. Then, the toner particles remaining on the outer peripheral surface of the photoreceptor and the toner particles transferred onto the outer peripheral surface of the intermediate transfer section were picked up by attaching adhesive tapes to the outer peripheral surface of the photoreceptor and the outer peripheral surface of the intermediate transfer section, respectively.

Thereafter, the adhesive tapes carrying the toner particles were attached to recording papers so as to transfer the toner particles to each of the recording papers. And then, an amount of the toner particles attached to each of the adhesive tapes was measured using the recording papers. Based on the measurement values, a transferring efficiency was calculated and the calculated results were evaluated according to the following four criteria A to D. Here, the transferring efficiency is defined by a value obtained by dividing the amount of the toner particles picked up from the intermediate transfer section by the sum of both the amount of the toner particles picked up from the intermediate transfer section and the amount of the toner particles picked up from the photoreceptor and further multiplying by 100.

A: Transferring efficiency was 95% or higher, and the transferring efficiency was very good.

B: Transferring efficiency was 90% or higher but lower than 95%, and the transferring efficiency was good.

C: Transferring efficiency was 80% or higher but lower than 90%, and the transferring efficiency was normal in practical use.

D: Transferring efficiency was lower than 80%, and the transferring efficiency was bad.

2.3 Positively Charge Property

Potential differences of the liquid developers of different colors obtained in the Examples 1 to 11 and the Comparative Examples 1 and 2 were measured by using a microscope type laser zeta potential meter (ZC-2000 produced by Microtec Nition Corporation), and the measurement results were evaluated according to the following five criteria A to E. In this regard, it is to be noted that zeta potential of each liquid developer was measured as follows.

First, each liquid developer was diluted with a solvent, and then each diluted liquid developer was put in a transparent cell having a diameter of 10 mm. Next, the transparent cell was set to the microscope type laser zeta potential meter, and then a voltage of 300 V was applied between electrodes (interval therebetween was 9 mm) of the microscope type laser zeta potential meter.

At the same time, movement of the toner particles was observed with a microscope to calculate their moving speed by the microscope type laser zeta potential meter, and zeta potential of each liquid developer was obtained based on the calculated moving speed values.

A: Potential difference was+100 mV or higher (very good).

B: Potential difference was+85 mV or higher but lower than+100 mV (good).

C: Potential difference was+70 mV or higher but lower than+85 mV (normal).

D: Potential difference was+50 mV or higher but lower than+70 mV (bad).

E: Potential difference was lower than+50 mV (very bad).

2.4 Dispersibility Test—1

The liquid developer of 10 ml obtained in each of the Examples 1 to 11 and the Comparative Examples 1 and 2 was supplied to a test tube (bore diameter thereof was 12 mm, and length thereof was 120 mm). After the liquid developer in the test tube was being placed in static condition for a weeks a settling depth of the toner particles in each test tube was measured and the measured results were evaluated according to the following four criteria A to D.

A: Settling depth of toner particles was 0 mm.

B: Settling depth of toner particles was 0 mm or higher but lower than 2 mm.

C: Settling depth of toner particles was 2 mm or higher but lower than 5 mm.

D: Settling depth of toner particles was 5 mm or higher.

2.5 Dispersibility Test—2

The liquid developer of 45.5 ml obtained in each of the Examples 1 to 11 and the Comparative Examples 1 and 2 was supplied to a centrifugation tube. After the liquid developer was separated by a centrifugal machine (produced by KOKUSAN CORPORATION) under the conditions in which a radius of rotation was 5 cm, a number of revolution was changed to 500, 1,000, 2,000, 4,000, and 5,000 rpm, and a time was 3 minutes, a settling depth according to each of the rotation speeds (rpm) was measured.

Next, the values measured as described above were plotted with a centrifugal acceleration $r\omega^2$ ($r\omega^2$=1118×radius of rotation (cm)×square of numbers of revolution per minute (rpm)×$10^{-8}$×g (acceleration of gravity)) as the horizontal axis and a settling depth as the vertical axis. Based on the plotted datum, a slope k of each of the liquid developers was calculated by the first approximation and the calculated results were evaluated according to the following four criteria A to D. In this regard, the lower the value of the slope k becomes, the higher dispersibility of the toner particles becomes.

A: $0 \leqq k < 0.004$

B: $0.004 \leqq k < 0.008$

C: $0.008 \leqq k < 0.012$

D: $k \geqq 0.012$ 2.6 Fixing Strength (Fixing Characteristics)

By using the image forming apparatus shown in FIG. 1 and FIG. 2, images each having a predetermined pattern were formed on recording papers (High quality paper LPCPPA4 produced by Seiko Epson Corporation) using the liquid developers of different colors of the Examples 1 to 11 and the Comparative Examples 1 and 2, respectively. Then, the images formed on the papers were thermally fixed onto the papers using a fixing apparatus as shown in FIG. 4. The thermal fixing was carried out by setting a temperature of a heat fixing roller at 100° C.

Thereafter, after it was confirmed as to whether or not a non-offset area was present, the fixed image on each of the papers was rubbed out twice using a sand eraser ("LION 261-11", Product of LION OFFICE PRODUCTS CORP.) with a pressure loading of 1.2 kgf/cm$^2$. Then, the residual rate of the image density of each recording paper was measured by a colorimeter "X-Rite model 404" (X-Rite Incorporated), and the measurement results were evaluated according to the following five criteria A to E.

A: Residual rate of the image density was 95% or higher (very good).

B: Residual rate of the image density was 90% or higher but lower than 95% (good).

C: Residual rate of the image density was 80% or higher but lower than 90% (normal).

D: Residual rate of the image density was 70% or higher but lower than 80% (bad).

E: Residual rate of the image density was lower than 70% (very bad).

These results are shown in the following Table 2.

Table 2

TABLE 2

| | Developing efficiency | Transferring efficiency | Positively charge property | Dispersibility test-1 | Dispersibility test-2 | Fixing strength |
|---|---|---|---|---|---|---|
| Ex. 1 | A | A | A | A | A | A |
| Ex. 2 | B | B | A | B | B | A |
| Ex. 3 | B | A | A | A | A | B |
| Ex. 4 | A | A | A | A | A | B |
| Ex. 5 | B | B | B | B | B | C |
| Ex. 6 | B | B | B | A | A | C |
| Ex. 7 | A | A | A | A | A | A |
| Ex. 8 | B | B | A | A | A | C |
| Ex. 9 | B | A | A | A | A | B |
| Ex. 10 | B | B | B | B | B | B |
| Ex. 11 | B | B | B | B | B | A |
| Comp. Ex. 1 | C | D | E | C | C | A |
| Comp. Ex. 2 | E | D | E | D | D | A |

As shown in the Table 2, the liquid developers according to the present invention (that is, the liquid developers of the Examples 1 to 11) had excellent charge property (positive charge property) and excellent dispersibility of the toner particles for a long period of time. Further, the liquid developers had excellent developing efficiency, transferring efficiency and fixing strength. In contrast, in the liquid developers of different colors of the Comparative Examples 1 and 2, satisfactory results could not be obtained.

3 Production of Liquid Developer

Liquid developers were produced as follows.

Example 12

First, toner particles were produced. In this regard, it is to be noted that in this specification steps of the liquid developer in which a temperature is not mentioned were carried out at room temperature (25° C.).

Step of Preparing Dispersion Liquid

Preparation of Coloring Agent Master Batch

First, a mixture of 48 parts by weight of a polyester resin L1 (acid value thereof was 8.5 mgKOH/g, weight-average molecular weight Mw thereof was 5,200, glass transition temperature Tg thereof was 46° C., and softening point Tf thereof was 95° C.) as a first polyester resin having a low molecular weight and 12 parts by weight of a polyester resin L2 (acid value thereof was 16.0 mgKOH/g, weight-average molecular weight Mw thereof was 237,000, glass transition temperature Tg thereof was 63° C., and softening point Tf thereof was 182° C.) as a second polyester resin having a high molecular weight were prepared as a polyester resin.

Next, the mixture of the polyester resins (the first polyester resin and the second polyester resin) and a cyanine pigment ("Pigment Blue 15:3", produced by Dainichiseika Color & Chemicals Mfg. Co., Ltd.) as a coloring agent were prepared. These components were mixed at a mass ratio of 50:50 using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled. The kneaded material that had been cooled as described above was coarsely ground using a hammer mill to be formed into powder constituting a coloring agent master batch which had an average particle size of 1.0 mm or less. In this way, the coloring agent master batch was obtained.

Preparation of Resin Solution

Next, 175 parts by weight of methylethylketone, 172.3 parts by weight of the mixture of the polyester resins described above, and 55.3 parts by weight of rosin modified phenol resin ("TAMANOL135" produced by ARAKAWA CHEMICAL INDUSTRIES, LTD., acid value thereof was 18 mgKOH/g, softening point thereof was in a range of 130 to 140° C., and weight-average molecular weight was 15,000) were added into a flask in which 97.5 parts by weight of the coloring agent master batch was contained to obtain a mixture and then the mixture was stirred with a high speed disperser ("T.K. ROBOMIX/T.K. HOMO DISPER MODEL 2.5" produced by PRIMIX Corporation, which are the registered trademarks). And then, 1.38 parts by weight of NEOGEN SC-F (an emulsifying agent produced by DAI-ICHI KOGYO SEIYAKU Co., LTD.) was added into the mixture to obtain a resin solution. In the resin solution, the pigment was finely dispersed homogeneously.

Formation of Dispersoid

Next, 72.8 parts by weight of 1N ammonia water was added to the resin solution in the flask to obtain a mixture. Then, the mixture was sufficiently stirred by a high speed disperser ("T.K. ROBOMIX/T.K. HOMO DISPER MODEL 2.5" produced by PRIMIX Corporation, which are the registered trademarks) under the conditions that a rotational velocity of a tip of a stirring blade thereof was 7.5 m/s. Thereafter, 400 parts by weight of deionized water was added into the mixture in the flask drop by drop under the conditions that the temperature of the mixture in the flask was adjusted at 25° C. and the mixture was stirred at 14.7 m/s of the rotational velocity of the tip of the stirring blade to thereby cause phase inversion emulsification. Thereafter, 100 parts by weight of deionized water was added into the mixture in the flask while stirring the mixture. In this way, a water-based dispersion liquid in which a dispersoid composed of the resin material (the polyester resin and the rosin resin) was dispersed was obtained.

Associated Particle Formation Step Next, the water-based dispersion liquid was put into a stirring flask having a max-blend stirring blade. Then, the water-based dispersion liquid was continued to be stirred under the conditions that the temperature of the water-based dispersion liquid in the stirring flask was adjusted at 25° C. and the water-based dispersion liquid was stirred at 14.7 m/s of the rotational velocity of the tip of the stirring blade.

Thereafter, 200 parts by weight of 5.0% natrium sulfate solution was added into the water-based dispersion liquid drop by drop under the same conditions as described above to produce associated particles by associating fine particles of the dispersoid in the water-based dispersion liquid. After the addition of the natrium sulfate solution to the water-based dispersion liquid was ended, the water-based dispersion liquid was still continued to be stirred until the average particle size (the volume median diameter Dv (50)) of the associated particles became 2.5 μm to obtain an associated particle dispersion liquid. Thereafter, 200 parts by weight of deionized water was added into the associated particle dispersion liquid. In this way, the production process of the associated particles was completed.

Step of Removing Solvent in Associated Particle Dispersion Liquid

The associated particle dispersion liquid was dried under reduced pressure to remove the organic solvent (methylethylketone) so that an amount of a solid content in the associated particle dispersion liquid became 30 wt % and to thereby obtain a slurry containing the associated particles of the dispersoid.

Step of Washing

Next, by repeatedly carrying out the process that the slurry was separated into a solid content and a liquid content and then the solid content separated from the slurry was dispersed into deionized water to thereby obtain a slurry, the associated particles were washed. Thereafter, by using a suction filtration method, a wet cake containing the resin material (the polyester resin and the rosin resin) and the coloring agent was obtained. In this regard, an amount of moisture content in the wet cake was 35 wt %.

Step of Drying

Next, the wet cake was dried by using a vacuum drier to thereby obtain toner particles.

Dispersion Step 37.5 parts by weight of the thus obtained toner particles, 1.88 parts by weight of Disperbyk-116 as a dispersant (produced by BYK Japan KK, amine value thereby was 65 mgKOH/g), 150 parts by weight of rape oil as an insulation liquid ("higholec rape oil" produced by The Nisshin OilliO Group, Ltd.), and 0.5 parts by weight of aluminium stearate as a charge control agent (produced by NOF CORPORATION) were put in a ceramics pot (the size of the ceramic pot was 600 ml), and then zirconia balls each having a diameter of 1 mm were added in the ceramics pot so that a volume filling factor thereof became 85%.

They were then mixed by a desk pot mill at a rotational speed of 220 rpm for 24 hours, to thereby obtain a liquid developer which the toner particles were dispersed in the insulation liquid.

The average particle size (the volume median diameter Dv (50)) of the thus obtained toner particles was 1.86 μm. In this regard, it is to be noted that an average particle size of the associated particles and an average particle size of the toner particles obtained in each of the Examples 12 to 14 were measured in the volume basis with a particle analysis apparatus ("Mastersizer 2000" produced by Malvern Instruments Ltd.).

Further, a viscosity of the liquid developer at a temperature of 25° C. was 55 mPa·s.

Furthermore, a magenta liquid developer, a yellow liquid developer, and a black liquid developer which were the same as those described above were produced excepting that Pigment Red 238 (produced by Sanyo Color Works) as a magenta pigment, Pigment Yellow 180 (Clariant K.K.) as a yellow pigment, and a carbon black ("Printex L", produced by Degussa AG) as a black pigment were respectively used instead of the cyanine pigment.

Example 13

In Example 13, liquid developers of different colors were produced in the same manner as in the Example 12 except that the polyester resin L1 was changed to the polyester resin L2 as a first polyester resin shown in Table 3 and the polyester resin H1 was changed to the polyester resin H2 as a second polyester resin shown in Table 3.

Example 14

In Example 14, liquid developers of different colors were produced in the same manner as in the Example 12 except that the polyester resin L1 and the polyester resin H1 were respectively changed to the polyester resin L3 as a first polyester resin and the polyester resin H3 as a second polyester resin shown in Table 3, and the ratio thereof in the resin material were changed to that shown in Table 4.

With respect to the Examples 12 to 14, a weight ratio between terephthalic acid (TPA) and isophtalic acid (IPA) in the monomer components to synthesize the polyester resins (first polyester resin L1-L3 and second polyester resin H1-H3), a weight ratio between ethylene glycol (EG) and neo-pentyl glycol (NPG) in the monomer components to synthesize the polyester resins (first polyester resin L1-L3 and second polyester resin H1-H3) and the like are shown in Table 3.

Further, the glass transition temperature Tg, the softening point Tf, the weight-average molecular weight Mw and acid values of the respective polyester resins are shown in Table 3.

Furthermore, the glass transition temperatures Tg of the first polyester resin and the second polyester resin in Table 3 were measured under the following conditions by using DSC ("DSC-220C" produced by Seiko Instruments Inc.) as a measurement apparatus. The conditions were set so that 10 mg of the resin material was added to an aluminum pan, a temperature raising speed was 10° C./min and a measurement temperature was in a range of 30 to 150° C. The measurement was carried out two times under the same conditions. The first round of the measurement was carried out at a raising and falling temperature of 10° C. to 150° C. to 10° C. The second round of the measurement was carried out under the same conditions as those of the first round of the measurement. In this regard, it was to be noted that the data of the second round of the measurement was used as each of the glass transition temperatures in Table 3.

Further, it is to be noted that the softening point Tf of each of the polyester resin in Table 3 was measured under the conditions that a temperature raising speed is 5° C./min and a diameter of a die hole is 1.0 mm in a high-floored flow tester (produced by Shimadzu Corporation) as a measurement apparatus.

with respect to the liquid developers of the Examples 12 to 14, the composition and the physical properties of each of the liquid developers, the physical properties of each of the dispersants in the liquid developers, and the amount of the dispersant with respect to the toner particles of 100 parts by weight in each of the liquid developers are shown in Table 4.

In Table 3 and Table 4, it is also to be noted that the polyester resin L1 as the first polyester resin is shown as "L1"/the polyester resin L2 as the first polyester resin is shown as "L2", and the polyester resin L3 as the first polyester resin is shown as "L3".

Further, in Table 3 and Table 4, it is also to be noted that the polyester resin H1 as the second polyester resin is shown as "H1", the polyester resin H2 as the second polyester resin is shown as "H2" and the polyester resin H3 as the second polyester resin is shown as "H3" and the polyester resin H4 as the second resin component is shown as "H4".

Further, in Table 4, it is also to be noted that rosin modified phenol resin is shown as "RP" and Disperbyk-116 as a dispersant is shown as "D116".

Table 3

TABLE 3

| | | First polyester resin | | | Second polyester resin | | |
|---|---|---|---|---|---|---|---|
| | | Polyester resin L1 | Polyester resin L2 | Polyester resin L3 | Polyester resin H1 | Polyester resin H2 | Polyester resin H3 |
| Use ratio of monomer component [parts by weight] | TPA:IPA | 40:60 | 60:40 | 80:20 | 70:30 | 70:30 | 74.5:25.5 |
| | EG:NPG | 50:50 | 50:50 | 100:0 | 60:40 | 60:40 | 100:0 |
| | W(EG)/W(NPG) | 1.0 | 1.0 | — | 1.5 | 1.5 | — |
| Characteristics | Tg[° C.] | 46 | 37 | 56 | 63 | 63 | 65 |
| | Tf[° C.] | 95 | 90 | 110 | 182 | 175 | 175 |
| | Mw | 5,200 | 3,900 | 8,900 | 237,000 | 359,900 | 78,000 |
| | Acid values [mgKOH/g] | 8.5 | 6.8 | 6.9 | 16.0 | 11.0 | 10.0 |

Table 4

TABLE 4

| | Liquid developer Toner particles Resin material | | | | | | | | |
|---|---|---|---|---|---|---|---|---|---|
| | Rosin resin | | | | | Polyester resin | | | |
| | | | | | | First polyester resin having a low molecular weight | | Second polyester resin having a high molecular weight | |
| | Kind | Acid values [mgKOH/g] | Softening point [° C.] | Weight-average molecular weight | Amount of rosin resin in resin material [wt %] | Kind | Amount of first polyester resin in polyester resin [wt %] | Kind | Amount of second polyester resin in polyester resin [wt %] |
| Ex. 12 | RP | 18 or less | 130-140 | 15000 | 20 | L1 | 80 | H1 | 20 |
| Ex. 13 | RP | 18 or less | 130-140 | 15000 | 20 | L2 | 80 | H2 | 20 |
| Ex. 14 | RP | 18 or less | 130-140 | 15000 | 20 | L3 | 60 | H3 | 40 |

TABLE 4-continued

| | Liquid developer | | | | | |
|---|---|---|---|---|---|---|
| | Dispersant | | | | | |
| | Polyester resin Amount of polyester resin in resin material [wt %] | Kind | Amine values [mgKOH/g] | Amount of dispersant to toner particles of 100 parts by weight [Parts by weight] | Kind of insulation liquid | Viscosity [mPa · S] |
| Ex. 12 | 80 | D116 | 65 | 5 | Rape oil | 55 |
| Ex. 13 | 80 | D116 | 65 | 5 | Rape oil | 58 |
| Ex. 14 | 80 | D116 | 65 | 5 | Rape oil | 62 |

For the respective liquid developers produced as described above, evaluations which were the same as the evaluations described above were made. Further, these results are shown in the following Table 5.

Table 5

TABLE 5

| | Developing efficiency | Transferring efficiency | Positively charge property | Dispersibility test-1 | Dispersibility test-2 | Fixing strength |
|---|---|---|---|---|---|---|
| Ex. 12 | A | A | A | A | A | A |
| Ex. 13 | A | A | A | A | A | A |
| Ex. 14 | A | A | A | A | A | A |

As shown in the Table 5, the liquid developers according to the present invention (that is, the liquid developers of the Examples 12 to 14) had excellent charge property (positive charge property) and excellent dispersibility of the toner particles for a long period of time. Further, the liquid developers had excellent developing efficiency, transferring efficiency and fixing strength.

What is claimed is:

1. A liquid developer, comprising:

an insulation liquid;

toner particles dispersed in the insulation liquid, at least a part of a surface of each of the toner particles containing a rosin resin; and a dispersant that improves dispersibility of the toner particles in the insulation liquid, the dispersant being consisted of a material having a predetermined amine value.

2. The liquid developer as claimed in claim 1, wherein the predetermined amine value of the material is in a range of 1 to 100 mgKOH/g.

3. The liquid developer as claimed in claim 1, wherein the material constituting the dispersant has at least one of secondary amine groups, tertiary amine groups and amide bonds in its chemical structure.

4. The liquid developer as claimed in claim 1, wherein in the liquid developer, an amount of the dispersant is in a range of 0.2 to 10 parts by weight with respect to 100 parts by weight of the toner particles.

5. The liquid developer as claimed in claim 1, wherein the toner particles contain a resin having ester bonds in its chemical structure in addition to the rosin resin.

6. The liquid developer as claimed in claim 1, wherein a softening point of the rosin resin is in a range of 80 to 190° C.

7. The liquid developer as claimed in claim 1, wherein a weight-average molecular weight of the rosin resin is in a range of 500 to 100000.

8. The liquid developer as claimed in claim 1, wherein the insulation liquid contains vegetable oil as a major component thereof.

9. An image forming apparatus, comprising:

a plurality of developing sections that form a plurality of monochromatic color images using a plurality of liquid developers of different colors;

an intermediate transfer section to which the plurality of monochromatic color images formed by the developing sections are sequentially transferred to form an intermediate transfer image which is formed by overlaying the transferred monochromatic color images one after another;

a secondary transfer section that transfers the intermediate transfer image onto a recording medium to form an unfixed image onto the recording medium; and a fixing device that fixes the unfixed image onto the recording medium;

wherein each of the plurality of liquid developers of different colors comprises an insulation liquid, toner particles dispersed in the insulation liquid, and a dispersant improving dispersibility of the toner particles in the insulation liquid, and wherein at least a part of the surface of each of the toner particles contains a rosin resin and the dispersant is consisted of a material having a predetermined amine value.

* * * * *